US008983017B2

(12) United States Patent
McIntyre et al.

(10) Patent No.: US 8,983,017 B2
(45) Date of Patent: Mar. 17, 2015

(54) ACCELERATOR DRIVEN SUB-CRITICAL CORE

(75) Inventors: Peter M. McIntyre, College Station, TX (US); Akhdiyor Sattarov, College Station, TX (US)

(73) Assignee: Texas A&M University System, College Station, TX (US)

( * ) Notice: Subject to any disclaimer, the term of this patent is extended or adjusted under 35 U.S.C. 154(b) by 679 days.

(21) Appl. No.: 13/222,652

(22) Filed: Aug. 31, 2011

(65) Prior Publication Data

US 2013/0051508 A1 Feb. 28, 2013

Related U.S. Application Data

(60) Provisional application No. 61/378,741, filed on Aug. 31, 2010.

(51) Int. Cl.
*G21G 1/12* (2006.01)
*G21G 1/08* (2006.01)

(52) U.S. Cl.
CPC ... *G21G 1/12* (2013.01); *G21G 1/08* (2013.01)
USPC ..... 376/195; 376/194; 376/190

(58) Field of Classification Search
CPC ..... G21G 1/00
USPC ..... 376/190, 194
See application file for complete search history.

(56) References Cited

U.S. PATENT DOCUMENTS

| | | | | |
|---|---|---|---|---|
| 5,774,514 | A | 6/1998 | Rubbia | |
| 2005/0013397 | A1* | 1/2005 | Csom et al. | 376/190 |
| 2011/0194662 | A1* | 8/2011 | Nolen et al. | 376/190 |

FOREIGN PATENT DOCUMENTS

| | | | |
|---|---|---|---|
| JP | 08-086893 | A2 | 4/1996 |
| JP | 2005-024457 | A | 1/2005 |
| WO | 0182306 | A2 | 11/2001 |

OTHER PUBLICATIONS

Bowman, "Accelerator-Driven Systems for Nuclear Waste Transmutation." Annu. Rev. Nucl. Part. Sci. 1998.*

Fitze, et al. "Developments at PSI (Including New RF Cavity)." Proc. of the 17th Int. Conf. on Cycl. and Their Appl. (Tokyo, Japan) 2004.*

McIntyre, et al. "Superconducting Sector Magnets for a Flux-Coupled Isochronous Cyclotron Stack." IEEE Trans. on Appl. Superconductivity, vol. 13, No. 2, Jun. 2003.*

International Application No. PCT/US2011/049982 Search Report and Written Opinion dated Apr. 25, 2012.

Korean Patent Application No. 10-2013-7008168 Office Action dated May 13, 2014 (9 pages).

* cited by examiner

*Primary Examiner* — Jack W Keith
*Assistant Examiner* — Sean P. Burke
(74) *Attorney, Agent, or Firm* — Conley Rose, P.C.

(57) ABSTRACT

Systems and methods for operating an accelerator driven sub-critical core. In one embodiment, a fission power generator includes a sub-critical core and a plurality of proton beam generators. Each of the proton beam generators is configured to concurrently provide a proton beam into a different area of the sub-critical core. Each proton beam scatters neutrons within the sub-critical core. The plurality of proton beam generators provides aggregate power to the sub-critical core, via the proton beams, to scatter neutrons sufficient to initiate fission in the sub-critical core.

14 Claims, 12 Drawing Sheets

ACCELERATOR DRIVEN SUB-CRITICAL CORE

CROSS-REFERENCE TO RELATED APPLICATION

The present application claims priority to U.S. Provisional Patent Application No. 61/378,741 filed on Aug. 31, 2010 entitled "Accelerator Driven Transmutation Fission Reactor and Method for Excitation and Control" which is hereby incorporated herein by reference in its entirety.

GOVERNMENT RIGHTS

This invention was made with Government support under the terms of Contract No. DE-FG03-95ER40924 awarded by the U.S. Department of Energy. The U.S. Government may have certain rights in this invention.

TECHNICAL FIELD

The present disclosure is generally related to nuclear power generation, and more specifically related to generation of nuclear power using an accelerator driven sub-critical core.

BACKGROUND

Generating power from nuclear fission utilizes a process in which fissionable nuclei of certain elements, for example uranium 235 ($^{235}$U), uranium 233 ($^{233}$U), or plutonium 239 ($^{239}$Pu) undergo spontaneous fission or fission stimulated by absorption of a neutron. During fission, a nucleus splits into two smaller nuclei and a number of free neutrons. Neutrons produced in a fission event typically have large kinetic energy, typically of order MeV, and are called fast neutrons. In a conventional nuclear reactor, a critical core typically includes fuel rods, or pins, containing fissionable nuclei. The fuel pins are arranged within a matrix of a material that decreases the kinetic energy of neutrons. This process is called moderation. A critical core is capable of self-sustained fission and is called a nuclear reactor.

Stimulated fission of a $^{235}$U nucleus has maximum probability for an incident neutron of low energy, typically of order eV, called a thermal neutron . . . Reactors using $^{235}$U fission utilize low-atomic-weight materials, such as water or carbon, as moderators because fast neutrons scattering from such light nuclei quickly lose kinetic energy and become available to stimulate fission. The fuel pins and moderator in a conventional $^{235}$U-fueled core are arranged so as to sustain an equilibrium in which just enough neutrons are produced in fission to stimulate more fission. Such an arrangement is called a critical pile. The condition of equilibrium must be stabilized by insertion or removal of additional rods of a material whose nuclei have large probability to capture neutrons (control rods). The insertion and removal of control rods can thus be used to maintain the neutron gain, or criticality, of the pile at the precise value of one; this situation is called a critical reaction. If too many neutrons are absorbed, the rate of fission decreases exponentially with time and the core shuts down. If too few neutrons are absorbed, the rate of fission increases exponentially with time and the core explodes.

A critical fission core can be used to generate a large amount of heat, the heat used to generate steam, and the steam used to drive electric generators. Water-moderated $^{235}$U-fueled fission reactors are commonly used to generate electric power.

In addition to stimulated fission, neutrons may be captured on certain heavy nuclei, for example uranium 238 ($^{238}$U) and thorium ($^{232}$Th), and through a sequence of such neutron capture and radioactive decay produce a fissionable nucleus such as $^{239}$Pu (from $^{238}$U) or $^{233}$U (from $^{232}$Th). This process is called breeding, and provides a mechanism by which the process of stimulated fission can actually produce additional fissionable nuclei within the core material Breeding can also lead to the formation of yet-heavier elements, beyond plutonium in the periodic table. Such elements are called minor actinides. Examples of minor actinides include neptunium (Np) and americium (Am). The minor actinides present a significant problem for safety of nuclear power, because they are produced in significant quantity in thermal reactors and they are the only elements that have radioactive decay half-life greater than a century and less than a million years. For example americium ($^{241}$Am) has a half-life of 432 years; $^{243}$AM has a half-life of 7,370 years. For that reason they present a serious problem for disposal of spent nuclear fuel.

SUMMARY

Systems and methods for operating an accelerator driven sub-critical core are disclosed herein. In one embodiment, a fission power generator includes a sub-critical core and a plurality of proton beam generators. Each of the proton beam generators is configured to concurrently provide a proton beam into a different area of the sub-critical core. Each proton beam scatters neutrons within the sub-critical core. The plurality of proton beam generators provides aggregate power to the sub-critical core, via the proton beams, to scatter neutrons sufficient to initiate fission in the sub-critical core.

In another embodiment, a method for reducing radioactive material includes injecting an externally produced minor actinide into a molten heavy salt eutectic core of a power generator. A plurality of proton beams is provided to the core. The minor actinide is split by fission in the molten heavy salt eutectic core.

In a further embodiment, a sub-critical nuclear power generation system includes a molten salt eutectic core. The molten salt eutectic core includes an inner core vessel, a molten mixture of fuel salt and carrier salt, and a plurality of spallation targets disposed within the molten salt eutectic core. Each spallation target is arranged to receive a different proton beam.

In yet another embodiment, a method for extending the life of a nuclear core includes providing a molten mixture of fuel salt and carrier salt in the core. A lanthanide extraction system is coupled to the core. The molten mixture is provided to the lanthanide extraction system as the core operates. Lanthanides are separated from the molten mixture in the lanthanide extraction system to generate a purified salt mixture as the core operates. The purified salt mixture is provided to the core.

BRIEF DESCRIPTION OF THE DRAWINGS

For a detailed description of exemplary embodiments of the invention, reference will now be made to the accompanying drawings, which may not be drawn to scale, and in which.

NOTATION AND NOMENCLATURE

Figure 1:
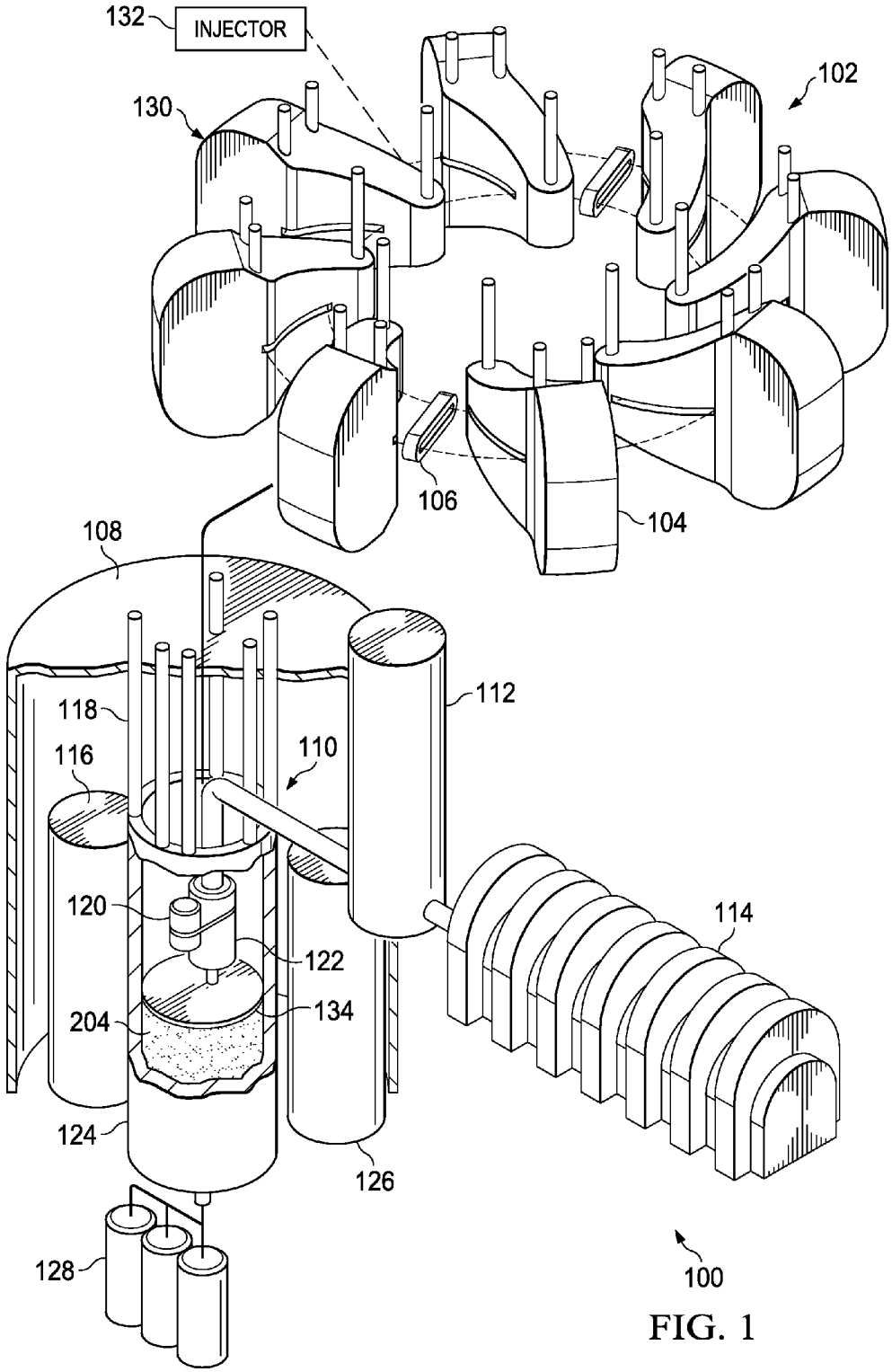
FIG. 1 shows a schematic diagram of a molten salt eutectic sub-critical core nuclear power generation system in accordance with various embodiments.

Certain terms are used throughout the following description and claims to refer to particular system components. As one skilled in the art will appreciate, the same component may be referred to by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections. The recitation "based on" is intended to mean "based at least in part on." Therefore, if X is based on Y, X may be based on Y and any number of other factors.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Power generation based on a critical fission core presents a number of challenges. The efficiency of systems employing a critical core is low. For example, only about 5% of the fertile fuel contained within a fuel pin may be consumed before accumulation of fission products makes the fuel pin unusable, necessitating premature replacement of the fuel pin. Thermal fission cores also produce significant quantities of minor actinides which remain radioactive for thousands of years. Such waste must be securely and safely stored. Further, the critical fission core is subject to catastrophic failure if core cooling or neutron gain is not carefully maintained.

Sub-critical cores contain fissionable fuel but they may be designed in a manner that they are incapable of a self-sustained fission chain reaction. In sub-critical cores, fission is initiated and maintained by introducing fast neutrons into the core from an outside source. A particle accelerator can be used to generate fast neutrons by spallation. Spallation is a process wherein a collision between particles, e.g., an accelerated proton and a target nucleus, results in the ejection of multiple particles (primarily fast neutrons) from the target nucleus. Thus, particle accelerator induced fission in a sub-critical core may be referred to as Accelerator Driven Sub-critical (ADS) fission.

ADS fission addresses at least some of the aforementioned challenges of critical fission cores. ADS fission is directly controlled by the particle beam. Thus, when the particle beam is disabled, ADS fission halts, providing direct control of the fission process. Furthermore, an ADS fission system may include sufficient thermal mass to preclude meltdown from radioactive heat after fission stops. ADS fission also provides greater flexibility for the composition and placement of fissile, fertile, or fission product waste within the core, and requires less enrichment of fissile content. ADS fission operates naturally in the fast neutron spectrum, rather than the thermal spectrum used by critical reactors. Use of fast-neutronics (i.e., neutron energies in the mega-electron-volt (MeV) range) provides an opportunity to burn minor actinide waste elements by fission in the core, thereby reducing the need for secure waste storage facilities and the attendant risks associated with waste and waste disposal.

In practice, ADS fission systems are not without difficulties. In order to drive a ~$GW_e$ ADS fission core, a continuous-wave (CW) proton beam of >700 MeV and ~10 megawatts (MW) beam power may be required. No conventional proton accelerator has yet achieved that performance, and accelerator system cost and reliability remain particular concerns. Beam reliability is particularly problematic in cores based upon the use of fuel pins because it can cause thermal shock and cracking of fuel pins.

All particle accelerators are prone to periodic beam interruptions. As noted above, fission stops with the proton beam. When fission stops, fuel pin temperature drops. The fuel pins are encased in a cladding material, such as zircaloy. Changes in temperature can thermally shock the fuel pin cladding, inducing fatigue and/or cracking that necessitate fuel pin replacement.

Finally, if the neutrons produced by spallation are produced as a line source in the center of a sub-critical core, fission products accumulating in fuel pins closest to the spallation source will block neutron propagation to the more distant fuel pins. As a consequence, fission occurs predominantly in the portion of the core nearest the spallation source, and the core must be periodically rebalanced by changing the positioning of the fuel pins. Access to the fuel pins for rebalancing presents undesirable security concerns.

Embodiments of the ADS fission systems of the present disclosure include features that overcome the deficiencies of critical cores and of conventional ADS systems which employ a single proton beam. Embodiments include multiple proton beam sources and multiple spallation targets. By incorporating multiple beams, embodiments generate the high beam power required to induce fission for power generation while also providing redundancy that enables core operation during beam interruption. Further, by dispersing the spallation targets about the core, core efficiency is enhanced and the need to reshuffle the fuel pins is reduced in those embodiments employing fuel pins.

Some embodiments of the ADS fission system disclosed herein include a molten salt eutectic rather than fuel pins and moderator. The molten salt eutectic includes a mixture of fuel salt and carrier salt. In a molten salt eutectic core, there is no fuel pin cladding and no concerns related to cladding. The molten salt core provides a number of additional advantages over a core employing fuel pins. As explained above, an ADS core using fast neutronics can burn long-lived radioactive waste. The molten salt core provides fast neutronics and advantageously allows waste produced by conventional cores to be added to the fuel salt and destroyed. Thus, the molten salt core disclosed herein provides a means for destroying minor actinide waste produced by other sources, such as critical fission cores. The molten salt core can also be fueled with spent nuclear fuel in which fission products have accumulated to a degree that the fuel can no longer be used to generate fission in a critical fission core.

The molten salt core allows for isolation and removal of fission products that absorb neutrons from the salt. Thus, embodiments are very efficient, allowing for complete or nearly complete consumption of all fertile fuel in the core. Furthermore, embodiments of the molten salt core herein disclosed provide fail-safe heat transfer. The core cannot melt through its containment even with a complete loss of power and coolant.

FIG. 1 shows a molten salt eutectic sub-critical core nuclear power generation system 100 in accordance with various embodiments. The power generation system 100 includes a molten salt core 110, a particle accelerator complex 102, one or more primary heat exchangers 122, one or more secondary heat exchangers 112, and at least one turbine generator 114. Molten salt from or in the core 110 transfers heat to molten sodium, non-fuel salt, or another secondary fluid that is suitable to transport heat, in the primary heat exchanger 122. The heated fluid flows from the primary heat exchanger 122 to the secondary heat exchanger 112. In the secondary heat exchanger 112, heat provided by the fluid is used to generate steam, or another suitable pressurized fluid, that drives the turbine generator 114 to generate electrical power. The primary and secondary heat exchangers 122, 112 may be tube-and-shell heat exchangers as known in the art. Though only a single turbine generator 114 is shown, in practice, the system 100 may include more than one turbine generator 114.

The power generation system 100 also includes a containment vessel 108, one or more lanthanide stills 120, a primary vessel 124, a set of conductive heat pipes 118, a lanthanide storage vessel 116, a volatile fission fragment storage vessel 126, and dump tanks 128. The lanthanide stills 120 and at least some portions of the primary heat exchangers 112 are contained within the primary vessel 124. The heat pipes 118 extend from the primary vessel 124 to a thermal sink. The primary vessel 124, lanthanide storage vessel 116, and volatile fission fragment storage vessel 126 are disposed within the containment vessel 108.

In some embodiments, the primary heat exchanger 122 is completely contained within the primary vessel 124 at a position above a neutron reflector 134. In such embodiments, the molten salt 204 is isolated within the primary vessel 124. The flow of the molten salt 204 to the primary heat exchanger 122 is sustained by at least one pump and connecting pipes that transfer molten salt 204 from a plenum disposed at the upper levels of the molten salt 204 to an inlet of the primary heat exchanger 122. Embodiments of the primary heat exchanger 122 may transfer 400 MW of heat and be no more than about 2.5 meters in height, providing sufficient space to accommodate three or more particle beams entering the top of the primary vessel 124.

The secondary fluid is circulated through the secondary tubing manifolds of the primary heat exchanger 122 by at least one pump and pipes connected to the secondary heat exchanger 112. Cooled molten salt 204 may flow from an outlet of the primary heat exchanger 122 to a cylindrical plenum shell forming an annulus just inside the side wall of the primary vessel 124. By directing the flow of cooled molten salt 214 downward along the side walls of the primary vessel 214, the surface temperature and corrosion of the side walls is reduced, thereby increasing the operating life of the primary vessel 124 (e.g., to up to 100 years).

Figure 2:
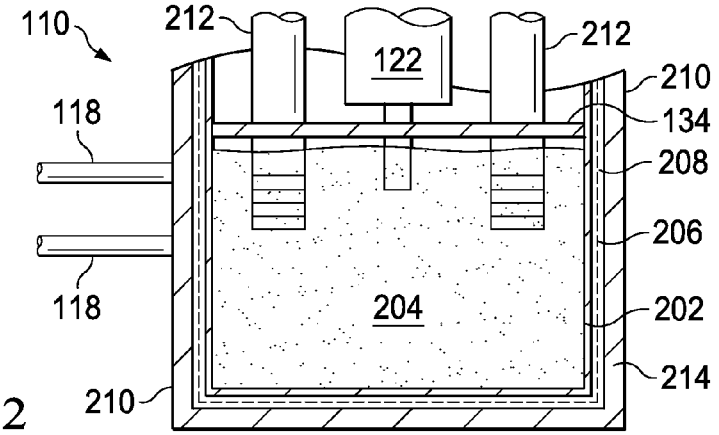
FIG. 2 shows a schematic diagram of the molten salt eutectic core in accordance with various embodiments.

FIG. 2 shows a schematic diagram of the sub-critical molten salt eutectic core 110 and portions of the primary vessel 124 in accordance with various embodiments. The primary vessel 124 includes an inner core vessel 202 and an outer core vessel 210. The inner core vessel 202 contains the molten salt eutectic 204. The outer core vessel 210 is disposed about the inner core vessel 202, and separated from the inner core by space 208 and multi-layer radiant heat shield 206. The outer core vessel 210 includes a reflector 214 that contains neutrons within the core 110, thereby minimizing core leakage. The reflector may include lead. In some embodiments, the outer core vessel 210 may include a lead filled stainless steel shell, and the walls of the outer core vessel 210 may be approximately 0.8 meters thick. The neutron shield 134 is disposed above the molten salt 204 to isolate components, such as the primary heat exchanger 122 and lanthanide still 120, from the core neutronics. The neutron shield 134 may also comprise lead. By positioning the primary heat exchanger 112 and other components above the molten salt 204 and the neutron reflector 134, embodiments avoid neutron damage to the heat exchanger 122 shell and tubing caused by fast neutrons, and avoid capture of fast neutrons by the metal of the primary of heat exchanger 122 that may soften the neutron spectrum of the core 110.

Some embodiments of the core 110 generate approximately 400 megawatts (MW) of heat, and the molten salt has a temperature of 600°-800° C. while the outer core vessel 210 operates at about room temperature. The space 208 between the inner core vessel 202 and the outer core vessel 210 is void of fluid (in a state of vacuum) when the core 110 is operating. The vacuum and the multi-layer heat shield 206 serve to inhibit conduction and/or radiation of heat from the inner core vessel 202 to the outer core vessel 210. In some embodiments, the vacuum and the multi-layer heat shield 206 limit the heat transferred from the inner core vessel 202 to the outer core vessel 210 to less than about 1 MW.

The space 208 also serves as a component of a safety subsystem of the system 100. Under conditions in which heat transfer from the molten salt 204 is inhibited, for example, a failure of the heat exchangers 122, 112, the space 208 may be filled with a fluid that facilitates conduction of heat from the inner core vessel 202 to the outer core vessel 210. Such a condition may occur, for example, if power is lost to the heat exchangers 122, 112. Under such conditions, fission and heating caused by fission are discontinued, but decay of fission products within the molten salt 204 continues to generate heat in the core 110 for a time. In some embodiments of the system 100, heat conduction between the core vessels 202 and 210 is provided by filling the space 208 with helium gas. The helium may be at atmospheric pressure. Thus, embodiments of the system 100 may include a helium source activated manually or automatically to fill the space 208 when thermal energy is to be conducted from the inner core vessel 202 to the outer core vessel 210. In other embodiments another thermally conductive fluid may be used in place of or in addition to helium.

The heat conducted to the outer core vessel 210 through the space 208 is absorbed, in large part, by the lead core of the outer vessel 210. A set of passive heat pipes 118 are connected to the outer core vessel 210. The conductive heat pipes 118 may be fluid filled and operate to conduct heat away from the outer core vessel 210 to heat dissipation structures, such as radiator panels or a geothermal heat sink. Because the molten salt 204 is in direct and constant contact with the surface of the inner core vessel 202, heat transfer from the salt 204 to the inner core vessel 202 is uninhibited. Thus, the molten salt eutectic 204 in combination with the described heat transfer features greatly enhance overall safety of the system 100 relative to conventional critical cores by making core meltdown extremely unlikely or impossible.

The molten salt eutectic 204 contained within the inner core vessel 202 includes a carrier salt and a fuel salt. The carrier salt may be NaCl and/or another suitable heavy salt. Some embodiments may use lithium salts or potassium salts. The carrier salt features relatively heavy atomic weight nuclides that contribute to the fast neutronics of the core 110 by maintaining neutron energy in the MeV range as neutrons collide with the carrier salt nuclei. In contrast, light salts and other light materials cause reduction of neutron energy on collision. The fuel salt may be, for example, a uranium salt including the same halide (chlorine, fluorine, bromine, etc.) as the carrier salt (e.g., uranium trichloride).

The neutron gain of the molten salt 204 is less than one (between 0.85 and 0.97 for example), and the salt mixture is consequently incapable of self-sustained fission. In the molten salt core 110, and other embodiments of a sub-critical core disclosed herein, the neutrons required to initiate and sustain fission are provided via spallation. The core 110 includes an array of spallation targets 212. Each spallation target 212 includes one or more metal plates. The metal plates are formed of a tough and ductile material, such as tungsten, and may be about 1 centimeter thick or more. A beam of energetic protons is guided to each spallation target 212, via an evacuated vacuum tube, from the particle accelerator complex 102. Assuming proton energy of about 800 mega-electron volts (MeV), each proton liberates approximately twenty neutrons. The liberated neutrons collide with the nuclei of the fuel salt to initiate fission.

Figure 14:
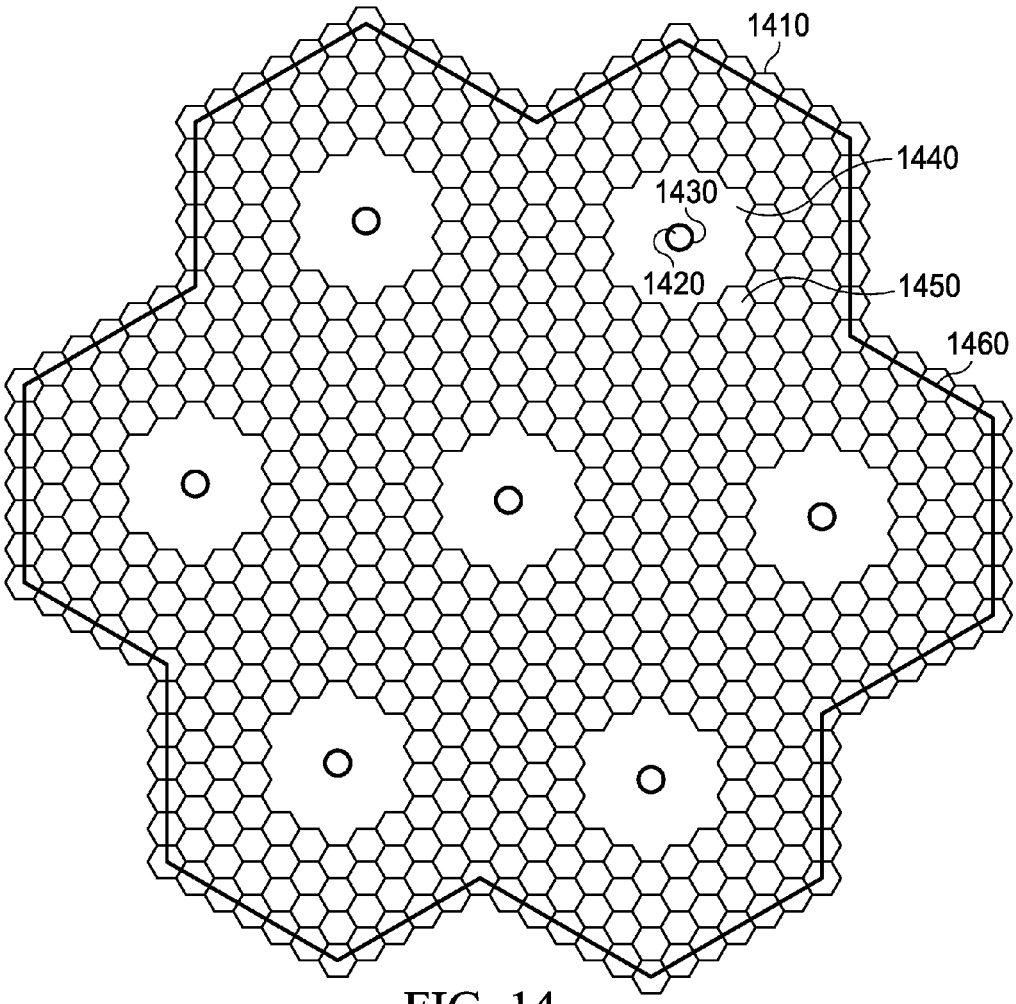
FIG. 14 illustrates overhead view of a proton beam distribution pattern in sub-critical nuclear core in accordance with various embodiments.

The spallation targets 212 are arranged symmetrically around the center of the inner core vessel 202 in a roughly circular pattern (e.g., see FIG. 14 for an exemplary arrangement of seven spallation targets). In some embodiments, the pattern may have a radius that is approximately ⅓ of the radius of the inner core vessel 202. Each spallation target 212 is driven with a proton beam generated by a different particle accelerator of the accelerator complex 102. By providing multiple spallation targets 212, each driven by a different proton beam, embodiments of the system 100 allow the core 110 to be driven with high aggregate beam power while employing accelerators that provide modest beam power. The multiple targets 212 and associated accelerators of the accelerator complex 102 also provide a level of redundancy, wherein failure of one accelerator does not shut down the core 110. Instead, embodiments of the system 100 can continue to operate, at a reduced power level, when one or more particle accelerators are inoperative. Furthermore, by distributing spallation neutrons evenly through the molten salt 204, the multiple proton beams enhance the efficiency of the core 110.

The fast neutronics provided by the heavy molten salt 204 allows the core 110 to breed fuel from non-fissile materials such as thorium, uranium 238 ($^{238}$U), etc. Via the process of transmutation wherein non-fissile nuclei capture neutrons in the core 110 and undergo radioactive decay, non-fissile materials can be transmuted into fissile materials such as uranium 233 or plutonium 239. For example, the fuel cycle for $^{238}$U involves transmuting $^{238}$U to $^{239}$U by neutron capture followed by beta decay to neptunium and plutonium 239.

The ultra-fast neutronics of the molten salt 204 also allows for fission of long-lived waste isotopes that are generated in the core 110. Waste materials (e.g., minor actinides, such as americium) having long half-lives (e.g., 1-10,000 years), that are bred in the core 110 will capture thermal neutrons, but are split by the fast neutrons of the core 110. Consequently, such waste materials do not accumulate in the core 110 over time, but rather settle at a low equilibrium level. Because the core 110 is configured to maintain an equilibrium level of minor actinides, the core 110 can be used to consume waste actinides produced by conventional cores, thereby reducing or eliminating the need to store the actinides and the attendant security concerns. Minor actinides or other waste generated by a conventional core can be periodically added to the molten salt 204 and consumed. Thus, the core 110 provides a method for destroying dangerous waste that would otherwise require secure storage.

Spent nuclear fuel contains a large quantity of the fertile nuclide $^{238}$U, modest quantities of the fissile nuclides $^{235}$U and $^{239}$PU, and a significant quantity of minor actinides. The power generation system 100 can be used to maintain an equilibrium in which the fertile nuclide $^{238}$U is transmuted into the fissile isotope $^{239}$PU, and the $^{239}$PU is fissioned, so that the inventory of $^{239}$PU remains roughly constant while the $^{238}$U is consumed. This equilibrium is called isobreeding, and makes it possible for the power generation system 100 to extract most of the available energy from the spent nuclear fuel.

The process of transmutation also breeds a portion of the $^{238}$U into heavier nuclides, including the minor actinides. In the fast neutronics of the molten salt 204 the probability for fission of the minor actinides is as great as the probability for breeding them, so the inventory of minor actinides does not continue to increase during the isobreeding cycle but reaches and remains at an equilibrium inventory.

In order to optimize destruction of minor actinides, some embodiments of the molten salt core 110 use thorium as the fertile nuclide in the molten salt 204. The low atomic weight of thorium maximizes the number of neutron captures required to breed minor actinides. The stable nuclide $^{232}$Th is 9 atomic mass units lighter than the minor actinide $^{241}$Am, and so it requires the capture of 9 fast neutrons in order to breed $^{232}$Th into $^{241}$Am, whereas it requires only 3 neutron captures to breed $^{238}$U into $^{241}$Am. For this reason, a thorium-fueled power generation system 100 has a much smaller equilibrium inventory of minor actinides than a uranium fueled system, and therefore may be used as an incinerator for minor actinides that had been produced in the operation of conventional fission power plants. For example, use of thorium rather than uranium in the molten salt 204 may reduce minor actinide inventory in the core 110 by a factor of $10^4$. Minor actinides from spent nuclear fuel may be separated chemically, and the separated minor actinides added periodically to the fuel salt 204 of an operating power generation system 100. The added minor actinides are consumed by fission, and the inventory of minor actinides would return to its equilibrium value, essentially without limit.

In some embodiments of the core 110, spent fuel pins may be disposed in the molten salt 204 to raise the initial neutron gain of the core 110. Over time, isobreeding raises the neutron gain of the molten salt 204 to a level sufficient to provide high core efficiency. Initially, however, the solubility of fuel salt (e.g. $UCl_3$) in the carrier salt may limit the molten salt 204 to a relatively low neutron gain (e.g., 0.7), which corresponding limits the initial efficiency of the core 110. The initial neutron gain of the molten salt 204 may be enhanced by addition of enriched uranium to the molten salt 204. Unfortunately, enriched uranium may raise security concerns. Therefore, the core 110 may advantageously include spent fuel pin assemblies removed from a conventional thermal core to raise the initial neutron gain of the core 110. The spent fuel pin assemblies may be symmetrically arranged in the core 110. For example, the spent fuel pin assemblies may be disposed about the perimeter of the primary vessel 122 in cooled molten salt 204 flowing in the annulus formed between the wall of the primary vessel 124 and the cylindrical plenum shell coupled to the output of the primary heat exchanger 122. By inclusion of the spent fuel pin assemblies, embodiments of the core 110 may raise initial neutron gain to about 0.95 or higher without use of enriched uranium.

In some embodiments of the core 110, fuel salt extracted from spent nuclear fuel provides fissile content sufficient for efficient operation of the core 110 from startup. In such embodiments, enrichment may not be required. An embodiment of the core 110 may include about 30 tons of uranium in the molten salt 204 and may generate 400 MW of continuously for 100 years or more. The uranium and other fertile and fissile components of the molten salt 204 may be extracted from spent nuclear fuel generated by a conventional reactor. The spent fuel produced by a conventional reactor may require removal and replacement at about five year intervals. The spent fuel contains about 80 tons of uranium and 328 kilograms of $^{239}$PU, and may be processed using the Experimental Breeder Reactor-II (EBR2) reprocessing technology to generate the fuel salt used by the core 110.

EBR2 reprocessing extracts the fuel from the fuel assemblies of spent nuclear into molten salt, and then deposits metallic uranium by electro-separation leaving all other components in the salt. Thirty tons of spent nuclear fuel may be processed through only the first stage of the EBR2 process to produce salt containing all the uranium and transuranic waste (TRU) of the spent fuel. The salt extracted from the thirty tons of spent fuel contains about 123 kg of $^{239}$PU. Another 420 tons of spent fuel may be processed through the full EBR2 process to extract the spent fuel into salt followed by separation of metallic uranium from TRU salt. The remnant salt contains about 4590 kilograms of $^{239}$PU. The remnant salt may be combined with the salt produced from the initial 30 tons of spent fuel to produce the fuel salt for the core 110. The fuel salt produced by combining the salts includes about 4.71 tons of $^{239}$PU and 30 tons of uranium, corresponding to a fissile content of about 13%. The remaining 415 tons of metallic uranium is available for other uses.

The amount of spent fuel reprocessed as described above is equivalent to about six five-year fuel cycles of a conventional reactor, and such amount may be available at any number of nuclear power generation sites. Consequently, an instance of the power generation system 100 may be co-located with a conventional reactor that provides the fuel for the core 110.

Returning again to FIG. 1, the power generation system 100 is configured to purify the molten salt 204 as the system 100 operates. The lanthanide stills 120 disposed in the primary vessel 124 extract lanthanides from the molten salt 204 while the core 110 is in operation. The extracted lanthanides are stored in the lanthanide storage vessel 116. Lanthanides are fission products that build up the molten salt 204 during system operation. The lanthanides have relatively large cross sections for absorbing the neutrons propagating within the core 110. Consequently, the build-up of lanthanides in the molten salt 204 makes neutrons unavailable for fission, and is therefore detrimental to the efficiency of the core 110. In conventional critical cores, the build-up of lanthanides in the fuel pins necessitates shuffling and/or premature replacement of the pins.

Embodiments of the power generation system 100 maintain high efficiency by extracting lanthanides from the molten salt 204 while the core 110 operates. The vapor pressure versus temperature of the lanthanides is about 100 times lower than that of the fuel salts (actinides). Consequently, the fuel salts can be separated from the lanthanides via heating and distillation in the lanthanide stills 120. The lanthanide stills 120 include heating elements that heat the molten salt 204 to a temperature that vaporizes the fuel and carrier salts, leaving the lanthanides. The vaporized salts are condensed using cooled molten salt 204 and returned to the core 110. The lanthanides are accumulated and stored in the lanthanide storage vessel 116 for removal when the core 110 removed from service. Removal of lanthanides from the molten salt 204 improves the efficiency of the core 110, and extends the useful life of the core 110 by allowing for the fuel salt to be more completely consumed. Furthermore, the extracted lanthanides are valuable rare-earth elements that can be recycled to produce various products.

Some lanthanide stills 120 employed in the system 100 utilize a batch distillation process. In the batch process, a quantity of molten salt 204 is processed at a periodic interval. Other embodiments of the lanthanide stills 120 employ a continuous distillation process. In the continuous process, molten salt 204 is constantly refined.

Some embodiments of the system 100 include one or more cryotraps for removing volatiles (such as krypton and xenon) created in the core 110. Gases are condensed in the cryotraps and stored in the volatile fission fragment storage vessel 126 for removal when the core is decommissioned. Some embodiments of the system 100 provide a stream of inert gas, such as helium, in the inner core vessel 202 to sweep volatiles into the cryotraps for extraction.

As explained above, each spallation target 212 of the core 110 is associated with a proton beam generated by the accelerator complex 102. The accelerator complex 102 includes a plurality of particle accelerators to generate the proton beams. For example, the accelerator complex 102 may include a different particle accelerator for each spallation target 212. Some embodiments of the accelerator complex 102 include isochronous cyclotrons serving as the particle accelerators.

The accelerator complex 102 also includes an injector 132. The injector 132 may produce a single proton beam or multiple proton beams. In some embodiments, the injector 132 may produce proton beams at kinetic energy in the range from 70 MeV to 200 MeV traveling at approximately one-third the speed of light. The cyclotron stack 130 may accelerate the proton beams before they reach the spallation targets 212. In some embodiments, each proton beam generated by an isochronous cyclotron of the accelerator complex 102 may produce an average of about 2 milliamps of current and 700 MeV. The protons beams provided to the core 110 may, in aggregate, provide about 10 MW or more of beam energy.

The isochronous cyclotrons of the accelerator complex 102 may be arranged as a cyclotron stack 130. The cyclotrons of the cyclotron stack 130 are independently operating isochronous cyclotrons, and are arranged in a flux-coupled vertical stack with minimal separation between cyclotrons. The vertical stacking allows the multiple cyclotrons to share a footprint approximately corresponding to that of a single cyclotron. Thus, embodiments of the accelerator complex 102 consume less space and are more economical than a corresponding number of convention particle accelerators. The cyclotrons share magnetic flux return while other subsystems (RF cavities, insertion, extraction, etc.) are independent, allowing continued operation of one cyclotron if another cyclotron fails.

Each cyclotron of cyclotron stack 130 generates one of the multiple proton beams used to drive the fission in core 110. Cumulatively, the accelerated beams from cyclotron stack 130 provide the beam current and/or energy to stimulate fission. Because no single beam is required to produce the desired amount of beam current and/or energy, core 110 may continue to operate even after one or more of the cyclotrons cease to operate. Moreover, using multiple proton beams alleviates the need to design a particle accelerator capable of producing a single beam with the desired level of beam current and energy.

As discussed in more detail below, the cyclotron stack 130 includes a magnetic ring containing a plurality of similar sector magnets, RF accelerating cavities, injection accelerator and injection channel, extraction channel, and beam transport to an injection channel on the core 110. The sector magnets and RF cavities of cyclotron stack 130 operate to accelerate the proton beams provided from injector 132. As the proton beams circle the cyclotron stack 130 they gain speed and energy causing the protons in the proton beam to move in a spiral pattern. As the protons reach their desired energy, they are ejected from cyclotron stack 130 and directed to core 110 of system 100 to initiate fission.

Figure 3:
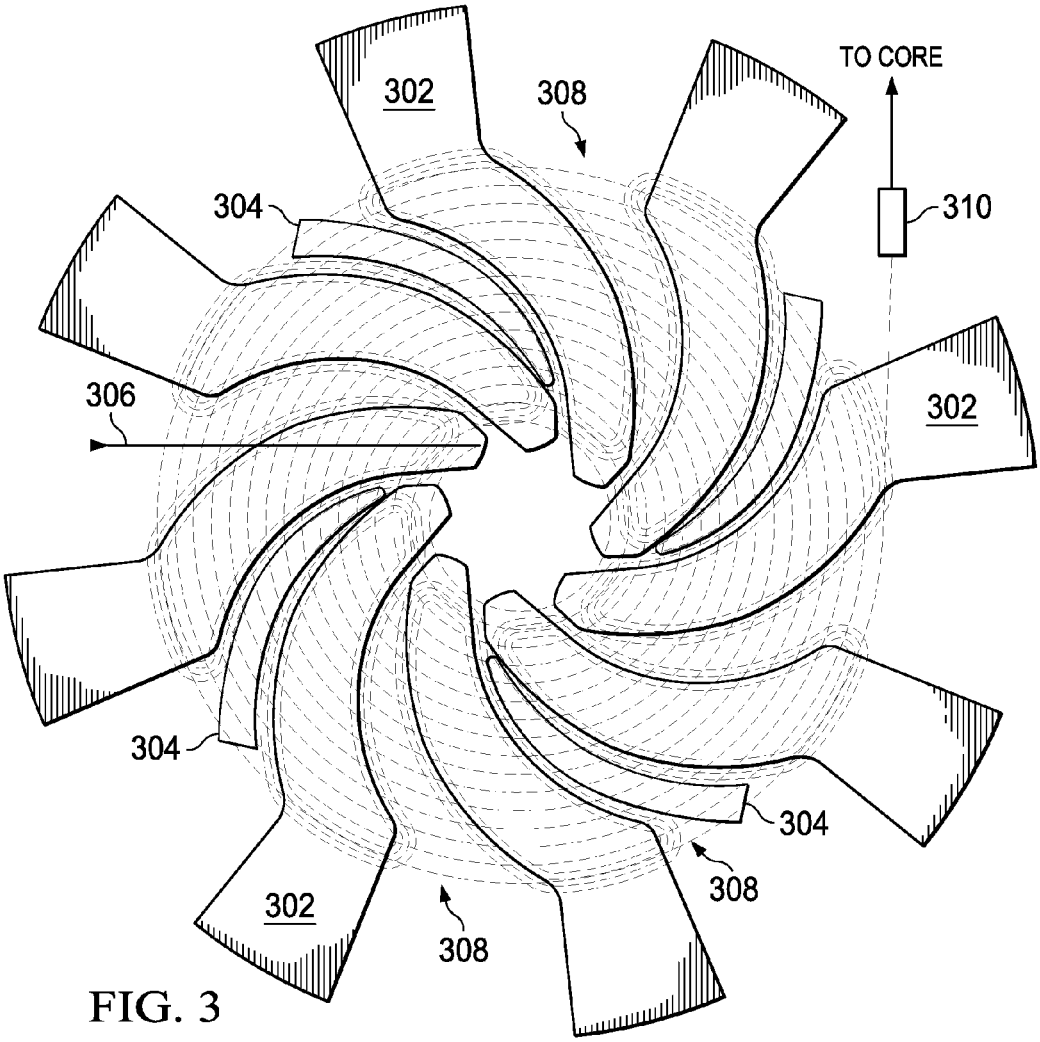
FIG. 3 shows a top view of an isochronous cyclotron stack in accordance with various embodiments.

FIG. 3 shows a top view of the isochronous cyclotron stack 130 in accordance with various embodiments. The cyclotron stack 130 includes a plurality (e.g., seven) vertically stacked cyclotrons. Each cyclotron may be able to receive a low energy proton beam 306 in a circular orbit in the inner radial region of the cyclotron which is accelerated before being directed to the core 110. The proton beam within each cyclotron may circulate in a relatively flat cylindrical vacuum tank enclosed within the gaps 308 of a symmetrical arrangement of magnetic dipole sector magnets 302. The multiple sector magnets 302, in conjunction with multiple RF cavities 304 arranged in gaps 308 between the sector magnets 302, accelerate the proton beams 306 received from the injector 132. Each cyclotron of the cyclotron stack 130 may include fewer RF cavities 304 than sector magnets 302. In some embodiments, the sector magnets 302 may comprise superferric fields in which the magnetic field produced is limited to less than what would saturate the steel in its flux return (e.g., approximately 1.8 T). The RF frequency of operation of the RF cavities 304 may be based on the revolution frequency of the proton beam in the cyclotron (e.g., about 50 MHz which corresponds to harmonic 8 of the revolution frequency in 1.8 Tesla guide field). In some embodiments, the RF cavities 304 may be superconducting RF cavities or dielectric-loaded superconducting RF cavities. In certain embodiments, the RF cavities 304 may be configured as a half-wave structure or as a shorted transmission line. The RF cavities 304 occupy less space than conventional RF cavities.

As each proton bunch gains kinetic energy it spirals towards the outer radial region of cyclotron stack 130. The pole geometry of sector magnets 302 may be designed so that the average bending field yields a constant orbit frequency even as the proton energy becomes comparable to its rest mass energy. This may allow synchronism with the RF field to be maintained. In some embodiments, an extraction septum electrode 310 may be situated to outwardly deflect the outermost proton orbit so that it can be extracted into a beam transport line coupled to the core 110.

The frequency of the RF field generated by the RF cavities 304 may be synchronous with an integral harmonic of the orbit frequency of the protons, thereby accelerating the protons by the cavity voltage V on each revolution of the proton orbit. In certain embodiments, the spiraling orbits of the accelerating protons may be spaced so as to increase the efficiency of extraction of a high-current beam at, for example, 800 MeV. In some embodiments, this spacing may be facilitated by providing a relatively high RF voltage V (e.g., a total of 1 MeV energy gain per turn of orbit). The spacing may be further facilitated by using a relatively low magnetic field (e.g., less than 1.8T) so the radial separation from a given energy gain per turn is maximized.

Figure 4:
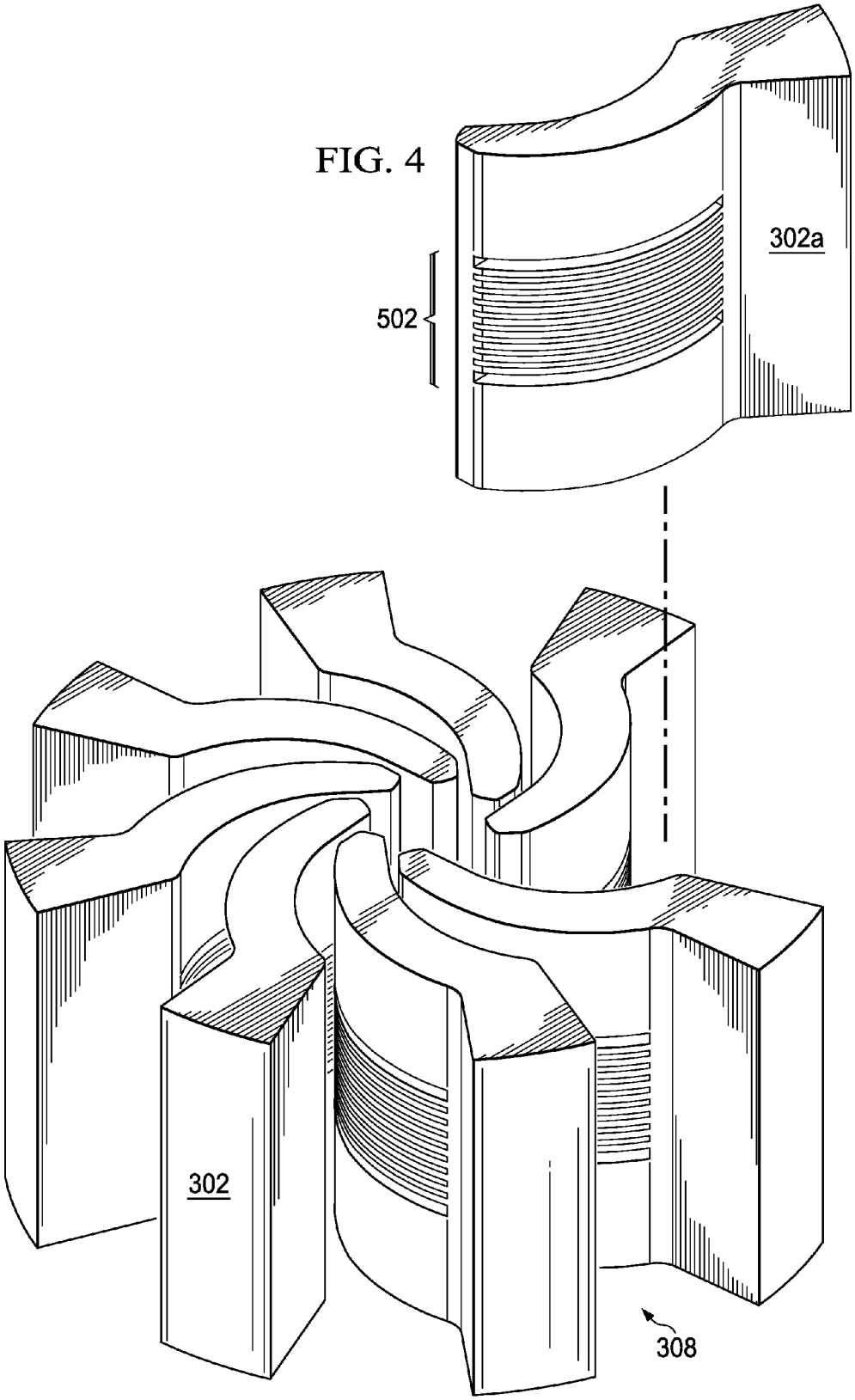
FIG. 4 shows a perspective view of a flux-coupled isochronous cyclotron stack in accordance with various embodiments.

FIG. 4 is a perspective view of the flux-coupled isochronous cyclotron stack 130 in accordance with particular embodiments. Sector magnet 302A is shown in isolation. The cyclotron stack 130 includes seven isochronous cyclotrons arranged in a vertical stack. Other embodiment of the cyclotron stack 103 may include a different number of cyclotrons. The proton beams of each cyclotron orbit in an aperture formed by adjacent pairs of the coil assemblies 502.

Figure 5A:
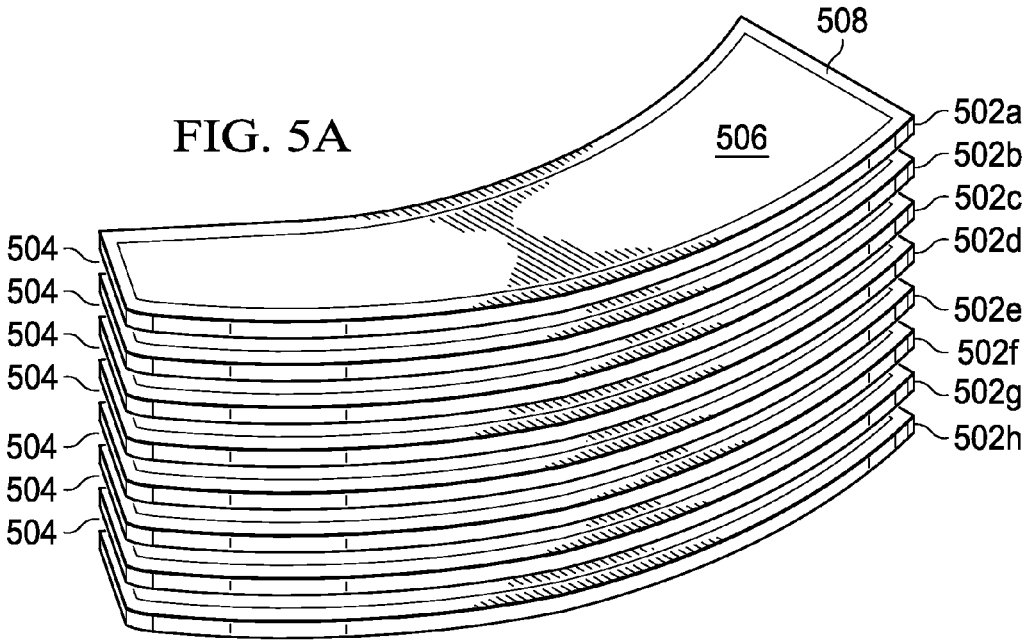
FIG. 5A shows a view coil assemblies of a sector magnet of a flux-coupled isochronous cyclotron in accordance with various embodiments.
Figure 5B:
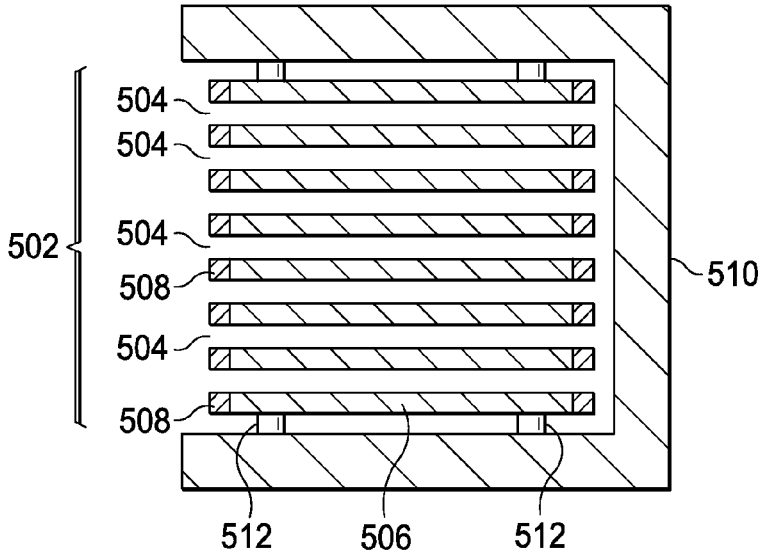
FIG. 5B shows a cross-section view of the coil assemblies of a sector magnet of a flux-coupled isochronous cyclotron in accordance with various embodiments.

FIG. 5A shows a perspective view of coil assemblies 502 of the sector magnet 302 in accordance with various embodiments. FIG. 5B shows a cross-sectional view of coil assemblies 502 of the sector magnet 302 in accordance with various embodiments. Sector magnet 302 includes a plurality of coil assemblies 502 (shown as 502A-H) which are supported in a vertical stack with vacuum gaps 504 between adjacent pairs of coil assemblies 502. The magnetic field for each cyclotron is generated by an adjacent pair of coil assemblies 502. Each coil assembly 502 consists of one or more superconducting windings 508 bonded to a magnetically permeable steel flux plate 506. In some embodiments, the superconducting windings may be niobium-titanium alloy. The vacuum gap 504 between each adjacent pair of coil assemblies 502 constitutes the aperture through which one proton beam circulates as it is accelerated in the respective cyclotron. The sector magnets 302 include eight coil assemblies 502 defining seven apertures (i.e., seven isochronous cyclotrons). The entire stack of coil assemblies 502 for sector magnet 302 is supported within the aperture of a C-shaped flux return 510 made of magnetically permeable steel. Magnetic flux passes from one gap 504 to the next and is returned through the single C-shaped room-temperature steel flux return 510 facilitated by flux plate 506. In some embodiments, coil assemblies 502 may be maintained at the cryogenic temperature of liquid helium, while the surrounding C-shaped flux return 510 is maintained at room temperature.

In certain embodiments, there may be a balancing of the Lorentz forces that are generated by the action on each coil assembly 502 by the magnetic field generated by all other elements. The balancing may be attained by appropriate design of the geometry of the superconducting winding assembly 508 and the succession of vacuum gaps 504 between them in the stack. This may have the benefit that the Lorentz forces, which can be immense in comparison to the gravitational weight of the segments, are held in balance one with the next. For example, the Lorentz forces from coil assembly 502C pulling up on coil assembly 502D may be approximately equal to the Lorentz forces from coil assembly 502E pulling down on coil assembly 502D. This balance may be attained with relatively little or no impact upon the magnetic field distribution in gaps 504. The tension support members 512 that support the stack of cryogenically cooled coil assemblies 502 within the room-temperature flux return 510 therefore may only need to support the gravitational weight of the elements, and not the much larger Lorentz forces. This may allow for the support of the huge Lorentz forces with a structure that would not be a thermal short between the 4K coil assembly and the warm-iron flux return. This benefit permits design of tension supports 512 allowing a reasonable minimum of conductive heat load through the supports 512.

In some embodiments of the sector magnets 302, the coil assemblies 502 are configured to produce alternating gradient quadrupole fields. The coil assemblies 502 generate an array of quadrupoles, one quadrupole centered on the equilibrium orbit of each consecutive beam orbit. The quadrupoles focus the proton beam to direct the beam along the equilibrium orbit of each turn in the cyclotron. By directing beam orbits in this manner, embodiments of the accelerator stack 130 require less calibration, setup, and maintenance than other cyclotrons, have larger acceptance of the beam phase space, and permit acceleration of larger beam current with smaller losses, making embodiments more suitable for industrial use.

Figure 6:
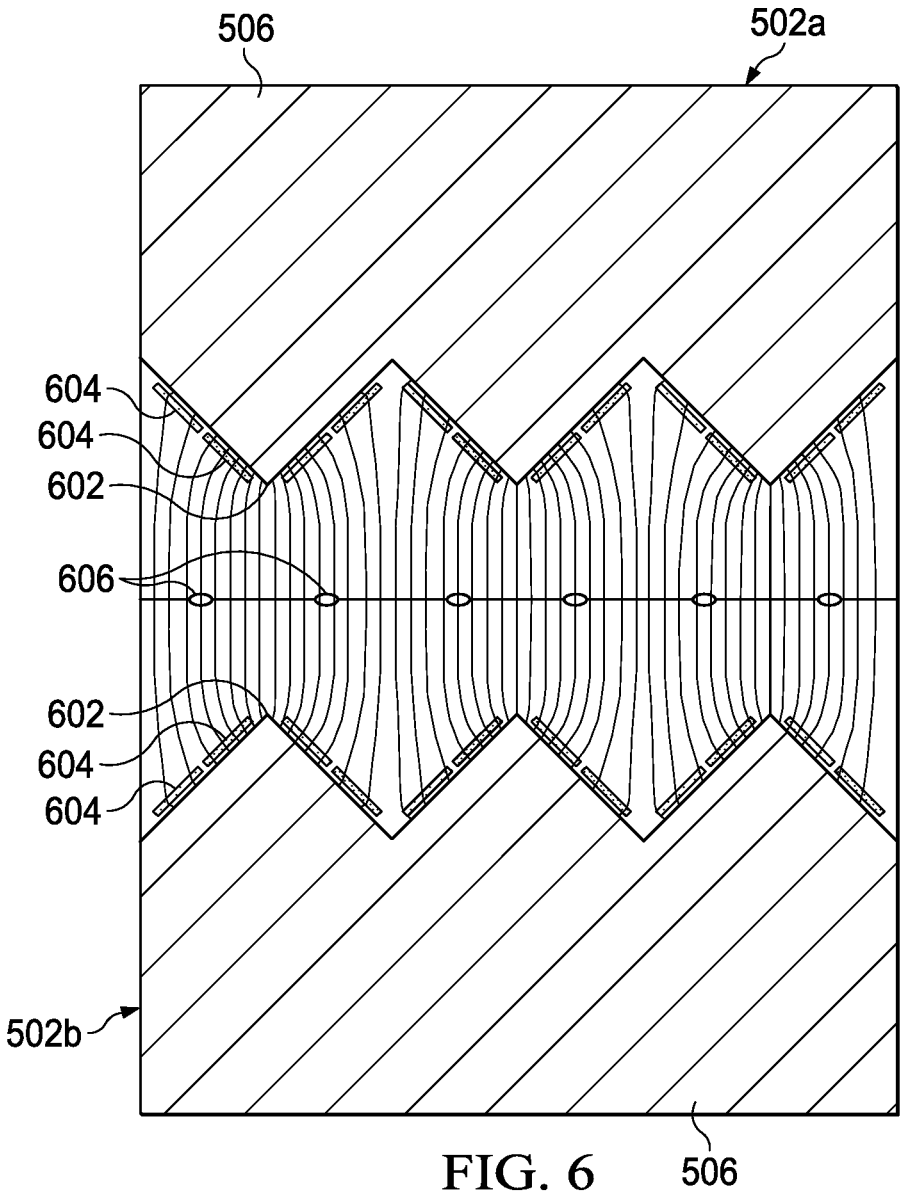
FIG. 6 shows a cross-sectional view of a pair of coil assemblies 502 configured to produce alternating gradient quadrupole fields in accordance with various embodiments.

FIG. 6 shows a cross-sectional view of a pair of coil assemblies 502 configured to produce alternating gradient quadrupole fields. In some embodiments of the coil assembly 502, the face of the coil assembly 502 includes a set of triangular or sawtooth ridges 602 that produce the quadrupoles defining the orbits 606 of the proton beam. In other embodiments, the face of the coil assembly 502 includes pole-face winding 604 that that produce the quadrupoles. Yet other embodiments include ridges 602 and pole-face windings 604. Other embodiments of the coil assembly 502 may include different shaped ridges and produce a different field, e.g., an octupole field. The ridges 602 and/or pole face windings 604 may be curved to form arcs corresponding to the desired beam orbits of the cyclotron.

FIG. 6 also shows magnetic field distribution in the gap between coil assemblies 502 equipped with both a ridged steel surface 602 and pole-face windings 604, driven by the main dipole winding for a 1.7 T dipole field. The quadrupole gradient produced by the ridges 802 alone is G ~1.5 T/m. The quadrupole gradient produced by the pole face winding 604 alone, excited with 1000 A/mm$^2$ in a 1 mm thick winding, is G~1 T/m. The quadrupole gradient produced by the combination of ridges 602 and windings 604 together is G~2.5 T/m, corresponding to a focal length for focusing the proton beam, as it passes through the sector dipole, of $$f[m] = \frac{.3G[T/m]l[m]}{p[\mathrm{GeV}/c]}.$$

In the mid-range of the cyclotron orbits:

$$l \cong 1\ \mathrm{m},\ p = \sqrt{2T/m} = .9\ \mathrm{GeV}/c,$$

$$p = \sqrt{2T/m} = \frac{.9\mathrm{GeV}}{c},\ \text{and}\ f = 0.8\ \mathrm{m}.$$

Some embodiments of the accelerator stack 130 configure the quadrupoles on successive sector magnets 302 to have alternating-sign gradient for each orbit; this produces a focus/defocus (FODO) alternating-gradient focal channel with transport beta function comparable to the focal length β~f, and betatron tunes ~2πR/β~10. Thus, embodiments of the accelerator stack 130 produce strong-focusing transport of the proton beam within the orbits of the each isochronous cyclotron using the pole-face quadrupoles described above.

Figure 7:
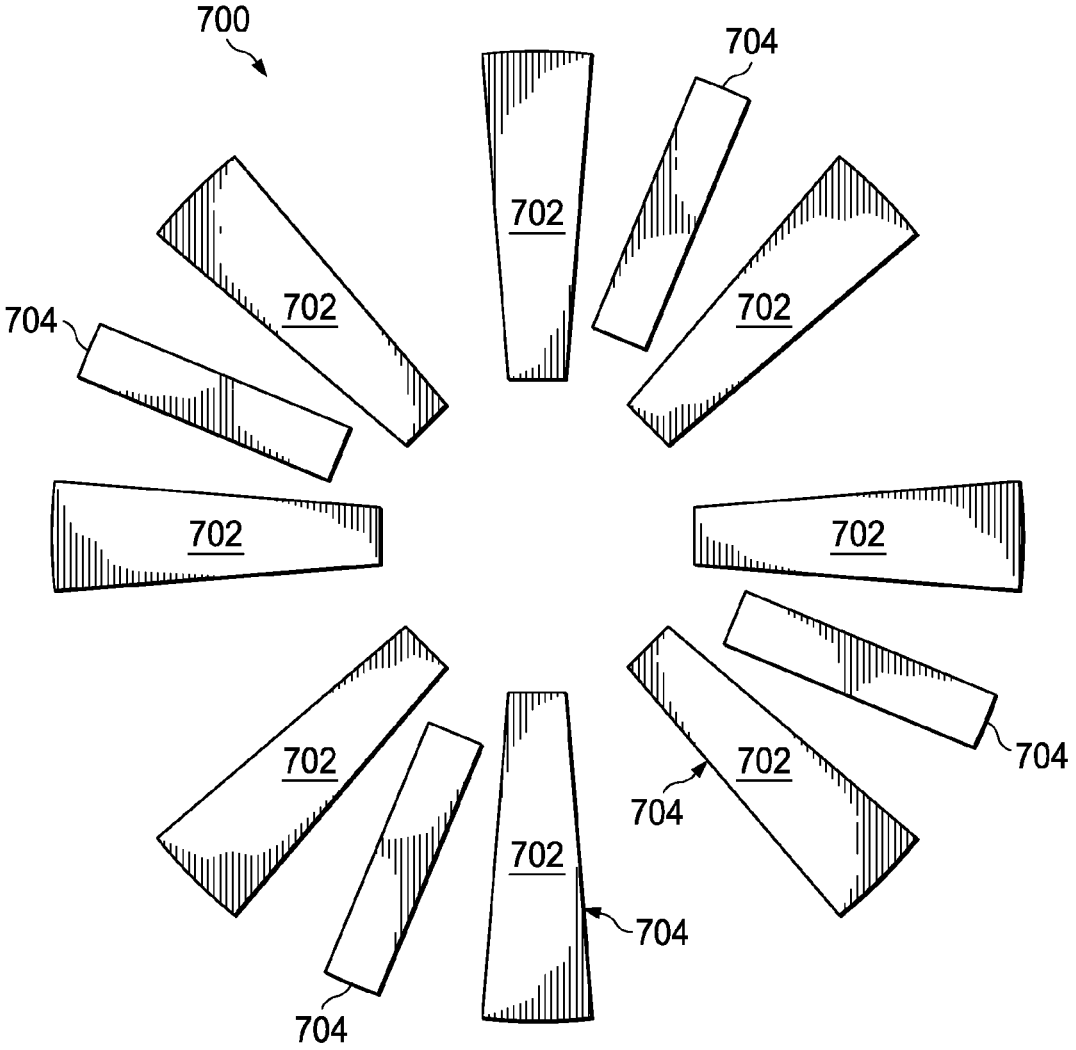
FIG. 7 shows a top view of a cyclotron stack including strong focusing in accordance with various embodiments.

The strong-focusing beam transport provides embodiments of the accelerator stack 130 with a number of advantages. By controlling the betatron tune, embodiments can make the tuning the same for all orbits, and can be used to select a tuning value that avoids fractional resonances and coupling resonances. Because the transverse size of the beam is inversely proportional to β, the beam size may be reduced by a factor of two or more compared to a conventional weak-focusing transport. Furthermore, while in a conventional isochronous cyclotron the sector magnets must be curved as spirals to produce vertical focusing in the fringe fields, embodiments of the accelerator stack 130 provide ample focusing the pole face method disclosed above and may employ uncurved sector magnets. This is advantageous because it simplifies location of the RF cavities in the spaces between sector magnets. FIG. 7 shows a top view of a cyclotron stack 700 including pole faces configured to generate a quadrupole gradient as described above. The sector magnets 702 include uncurved sides 704 that facilitate placement of the RF cavities 704. The cyclotron stack 700 may be substituted for the cyclotron stack 130 in embodiments of the accelerator complex 102.

Figure 8:
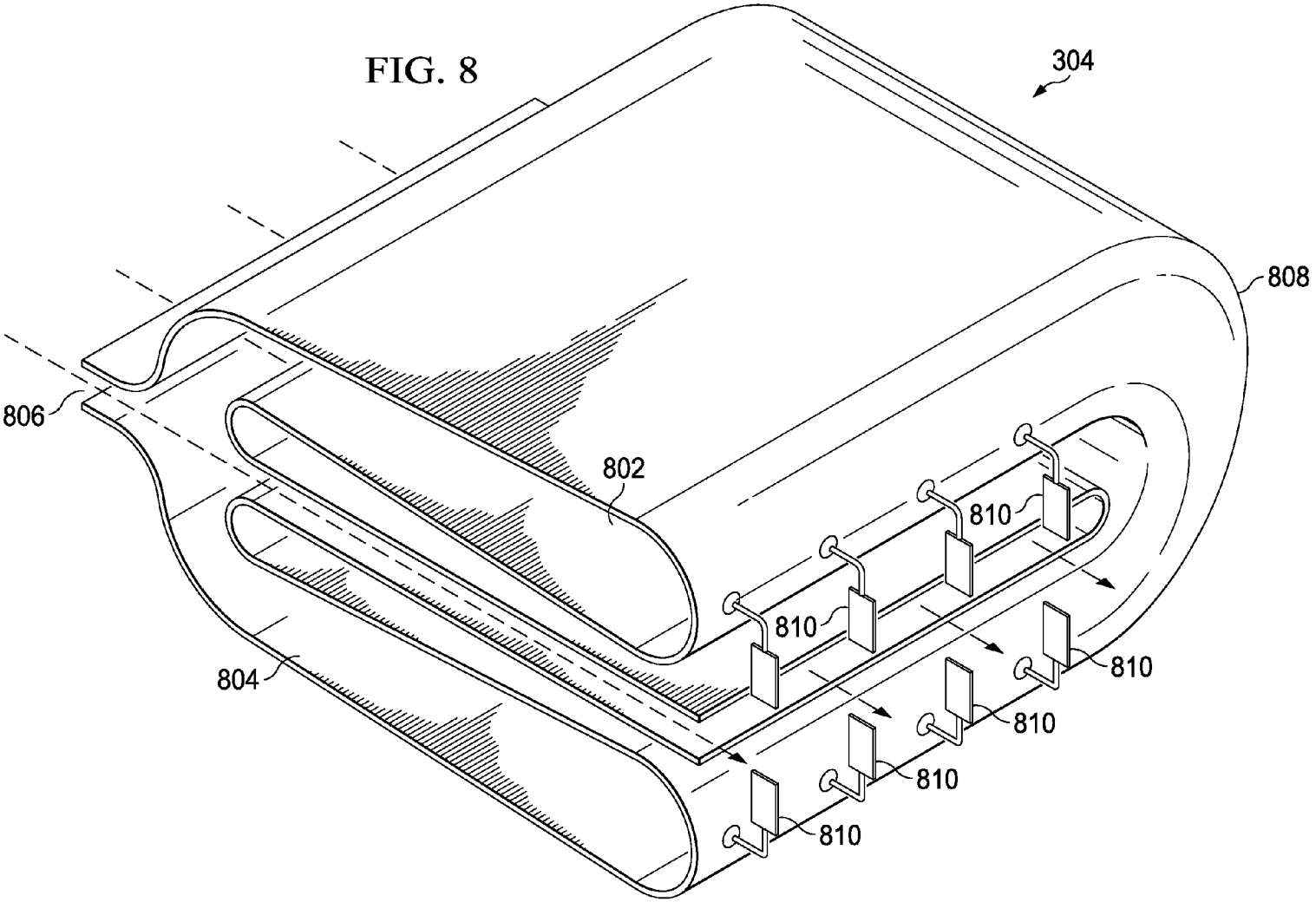
FIG. 8 shows a schematic view of an RF cavity suitable for use a cyclotron stack in accordance with various embodiments.

The cyclotron stack 130 arranges a plurality of cyclotrons in close proximity to one another. For example, cyclotron spacing in the sector magnet 302 may be approximately 0.35 meters or less. Embodiments of the cyclotron stack 130 include RF cavities 304 configured to operate within such dimensions. FIG. 8 shows a schematic diagram of a cutaway side view of an RF cavity 304 suitable for use with the cyclotron stack 130 in accordance with various embodiments. The RF cavity 304 comprises two RF chambers 802 and 804. RF chambers 802, 804 may be arranged symmetrically above and below the acceleration gap 806. RF chambers 802, 804 may be oriented parallel to the acceleration gap 806 (disposed in horizontal planes or planes parallel to the orbitary plane of the cyclotron) as shown. This arrangement may produce a symmetric pattern of accelerating electric fields in the region traversed by the proton beam. Such an above/below configuration may allow the half-wave or shorted stub-line geometry to be terminated at the innermost and outermost extent of the radial region bracketed by the cavity 304.

The RF cavity 304 is continuous and wraps on itself at both the inner (not shown) and outer end 808) of the cavity 304 to reduce or eliminate coupling to longitudinal modes for which the electric field is oriented to point towards or away from the center of the cyclotron. RF signal is coupled to the cavity 304 at points 810 at the far end of the chambers 802, 804. The system 100 may include solid state power amplifiers to drive the RF signal to the RF cavity 304. For example, one or more solid state RF power amplifier may be configured to drive RF signal to each point 810. The multiple power amplifiers provide redundancy and allow the cavity 302 to continue to operate should one or more power amplifiers fail. Multiple amplifiers may be used to introduce RF power in the same distribution in radius as the distribution of power that is delivered by the cavity to the successive orbits of proton beam, so that the currents on the cavity walls flow purely in the desired accelerating mode.

The walls of RF cavity 304 may be made from a superconducting material, such as niobium or other suitable superconductor, and refrigerated to a temperature suitable for superconducting operation. The RF cavity 304 may operate at the $4^{th}$ or $6^{th}$ harmonic of the revolution frequency of the protons' orbit through the cyclotron. In some embodiments, the RF cavity 304 may be capable of 1 MV accelerating voltage and excellent mode stability.

Figure 9:
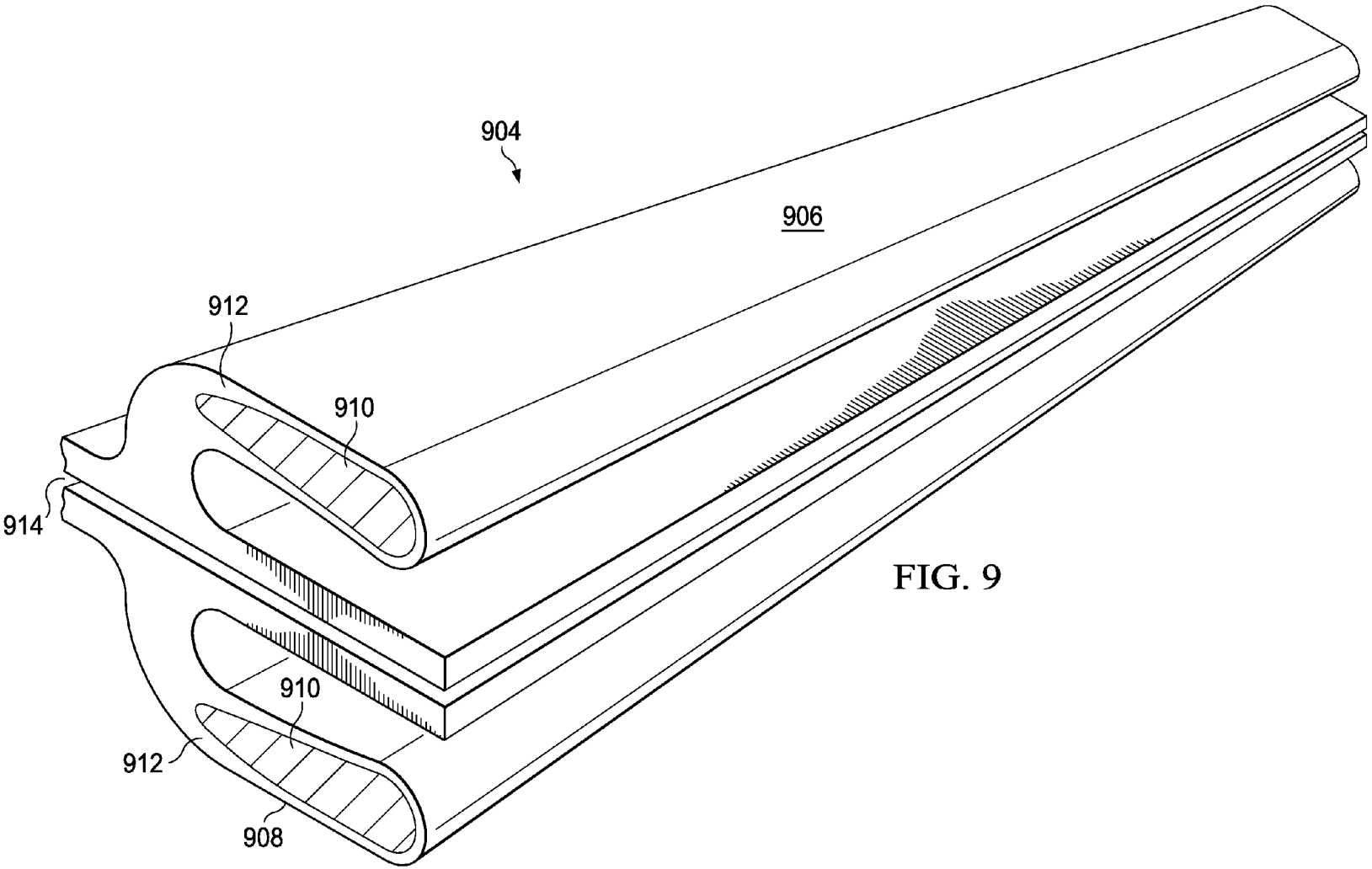
FIG. 9 shows a schematic view of an alternative RF cavity suitable for use with a stacked cyclotron in accordance with various embodiments.

FIG. 9 shows another embodiment of an RF cavity 904 suitable for use with the accelerator stack 130. The alternate cavity 904 includes horizontal chambers 906, 908. In certain embodiments, the RF cavity 904 may comprise a shorted transmission line containing a high-permittivity dielectric slab 910. In some embodiments, the dielectric slab 910 may comprise rutile ($\alpha$-phase $Ti_2O_3$) or another suitable material. The walls 912 of RF cavity 904 may be made from a superconducting material, such as niobium or other suitable superconductor. In some embodiments, the surface field may be kept within breakdown limits by providing slot space between the superconducting walls of RF cavity 904 and dielectric slab 910, and by tapering the width of the slot space so that the electric field in the slot space is made approximately constant throughout RF cavity 904.

In certain embodiments, the predominant share of RF losses may occur in dielectric slab 910. Maintaining dielectric slab 910 at a higher operating temperature than that of the superconducting walls 912 may improve the Carnot-cycle efficiency with which the heat from RF losses may be pumped to room temperature. In some embodiments, dielectric slab 910 within RF cavity 904 may be suspended clear of the walls 912 within the above-mentioned slot space. The walls 912 and dielectric slab 910 may be refrigerated at different temperatures. For example, the walls 912 may be refrigerated at approximately 4 K (the temperature of liquid helium, needed to sustain superconducting operation) and dielectric slab 910 at 20 K (using LNe coolant) or 80 K (using $LN_2$ coolant) to minimize loss tangent of the dielectric 910. Other, more advanced superconducting materials, such as Nb3Sn, may be used as a surface coating on the inner surface of the niobium cavity. This may permit operation at a higher temperature than with pure niobium, such as 8-12 K. The increase in temperature may improve the Carnot-cycle efficiency with which the heat from RF losses may be pumped to room temperature.

In some embodiments, RF cavity 904 may comprise a pattern of azimuthally oriented slots in the superconducting walls 912 to mode-lock the cavity 904 so that the fields and currents within the RF cavity 904 are maintained in the mode appropriate for its acceleration of proton bunches circulating in the beam. This form of mode selection may permit stabilization of the cavity 904 against distortions in the fields that would arise from beam loading, from power coupling, and/or from termination of the cavity structure at the outermost and innermost radial extent of each RF cavity 904.

The height of the dielectric 910 may be determined using the equation $$f = \frac{0.5 \cdot c}{\sqrt{\varepsilon} \cdot L}.$$

If it is assumed that the relative permittivity $\in$ of the material is 125 (the average value for rutile at room temperature), the target frequency f is 48 MHz, and the speed of light c is $3\times10^8$, then the height L of the dielectric is:

$$L = \frac{0.5 \cdot 3 \times 10^8}{\sqrt{125} \cdot 32 \times 10^6} = 0.42 \text{ m}.$$

For more complicated geometries, it may be suitable to use numerical methods to determine the height of the dielectric. Increasing the length of RF cavity 904 may reduce the amount of dielectric used, increase the insulating gap, and reduce the peak field in the structure.

Dielectric 910 may be recessed within RF chamber so that there is no line of sight from the proton beam as it passes through acceleration gap 914 (e.g., non-linear dynamical effects, inverse Cerenkov, etc). This may help to prevent a variety of secondary field interactions and charging phenomena that can limit high-current operation. In some embodiments, dielectric 910 may be separated from the walls of RF cavity 904 by a vacuum gap for thermal isolation. In particular embodiments, dielectric 910 may be supported in RF chambers 906, 908 via a pattern of rutile tubes that pass through cut-off holes in the walls of RF cavity 904. The rutile tubes may then be refrigerated with a forced flow of liquid nitrogen at 80K. This may allow for approximately 1 MV of accelerating voltage. In some embodiments, dielectric 910 may comprise fusion-bonded bricks wherein milled side faces form $LN_2$ coolant slots.

In certain instances, the geometric factor of RF chambers 906, 908 may be 4.25 W as determined from the equation $$G = \frac{\omega E}{\frac{1}{2}\int H^2 ds}.$$

Because the operating frequency may be low and the surface resistance may be scaled as a square of the frequency, the surface resistance of the niobium at 4.2 K is determined by residual resistance of the bulk niobium, which for cavity-grade niobium is less than 10 nΩ. The power dissipated on the niobium walls, at 4.2 K, 48 MHz, may be about 10 nW. The integral $\int H^2 ds$ is 2.1 $A^2/m$ (for 25.2 V across gap), corresponding to a wall dissipation of 33 W/m in the niobium for the full-geometry cavity. For a stack of 5 cyclotrons, each containing four 5-m-long cavities, this would constitute a cryogenic heat load of 3.5 kW at 4.2 K, equivalent to a mains power requirement of approximately 3 MW for refrigeration.

The Q-value of the cavity 904 may be about $3.3\times10^7$, with losses of 33 W/m (at 4.2K) for the superconducting walls 912 of RF chamber 908, 906 and 1.2 kW/m (at 77K) for dielectric 910. In some embodiments the shunt impedance of the dielectric-loaded shorted-stub cavity 904 may be $$R_{sh}=V^2/P_{diss}=803 \text{ MW}.$$

Losses from the walls 912 of RF cavity 904 may be about 250 W/m. Radiation heat load from a warmer dielectric may bring another 11 W/m. The total heat load on liquid helium refrigeration system may be about 261 W/m. In certain instances, a magnetic field on the walls of RF cavity 904 may be approximately 16000e.

In some embodiments, rectangular slots may be integrated into dielectric 910 to provide cooling. Dielectric 910 may be assembled from identical square-cross-section dielectric bricks in which one side face may be milled to form a rectangular pocket. The bricks may be fusion-bonded to seal the pocket channels so that they provide flow channels for coolant to flow. The brick size may provide sufficient surface heat transfer to keep within the 1 W/cm$^2$ limit that is typical for the transfer to liquid coolant to avoid boiling.

In some embodiments, the thickness of dielectric 910 may be tapered. This may help to maintain a roughly constant electric field level along acceleration gap 914. Accelerating voltage with no phase shift is defined as $$V_{acc} = \int_{-x_0}^{x_0} E_{gap}(x) \cdot \cos\left(\frac{\omega \cdot x}{v}\right) dx,$$

where w is an angular frequency, v is a speed of the particle and $x_0$ is half the width of the accelerating gap, with maximum E field at x=0.

In particular embodiments, the ends of RF cavity 904 may be terminated by continuing the superconducting walls around a U-turn beyond the region traversed by the proton beams. This may connect one cyclotron layer to the next. Another method for terminating the ends of RF cavity 904 may be to continue the superconducting wall of RF chambers 906, 908 without continuing dielectric 910. The superconducting wall 912 may extend with a logarithmic taper of the inner vertical separation. In both methods the magnetic fields can be maintained with little perturbation over the portion of acceleration gap 914 traversed by the proton beams.

Figure 10:
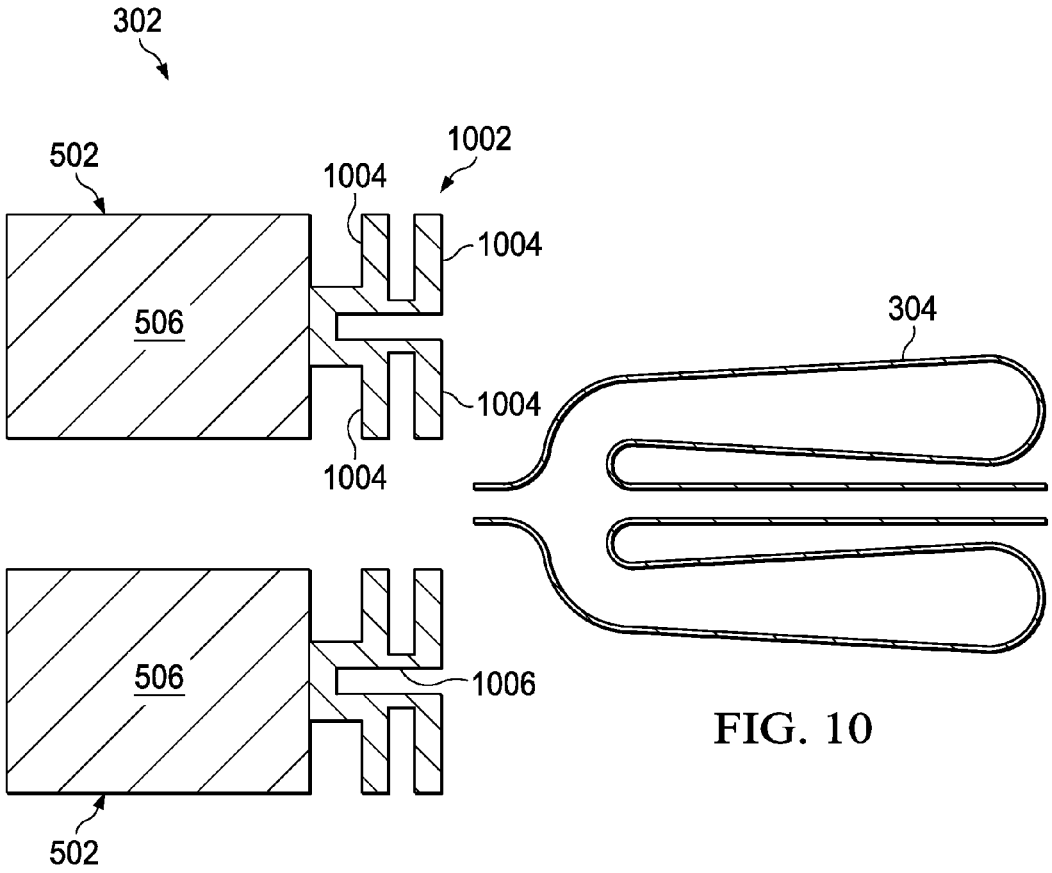
FIG. 10 shows a schematic view of a cross-section of an RF cavity 304 and associated magnetic shielding in accordance with various embodiments.

FIG. 10 shows a cross-sectional view of an RF cavity 304 and associated magnetic shielding 1002 in accordance with various embodiments. The accelerator complex 102 includes magnetic shielding 1002 disposed between each RF cavity 304 and adjacent sector magnet 302 in accordance with various embodiments. The arrangement of coil assemblies 502 produces a pattern of magnetic flux that primarily flows between adjacent coil assemblies 502. However, some of the magnetic flux may fringe into the regions flanking the sector magnet 302. The RF cavity 304 is positioned between sector magnets 302. The magnetic shielding 1002 shields the RF cavity 304 from the magnetic field produced by the coil assemblies 502 thereby preventing the magnetic field from saturating the superconductor of the cavity 304 and rendering the cavity 304 inoperable.

The magnetic shielding 1002 includes a plurality of metal plates 1004. The metal plates 1004 may be made from permeable steel, or from high-permeability alloy. Each plate 1004 extends vertically nearly to the plane of beam orbits, and is disposed to intercept fringe flux and conduct the flux back to the flux plate 506, thereby closing the flux path. Each plate 1004 connects to a horizontal plate segment that connects from the end of the plate farthest from the beam plane to the side wall of the flux plate 506. By creating a low-reluctance path for fringing magnetic flux, the level of flux reaching the cavity 304 is greatly reduced. A succession of multiple plates 1004 may be placed in this manner, with a gap space between successive plates 1004, to optimize shielding of the fringe field. For, example two plates 1004, may be disposed with suitable gapping, as shown in FIG. 10, that reduce the fringe of a 1.8 Tesla (T) sector magnet 302 to less than 10 mT at the cavity 304.

Figure 11:
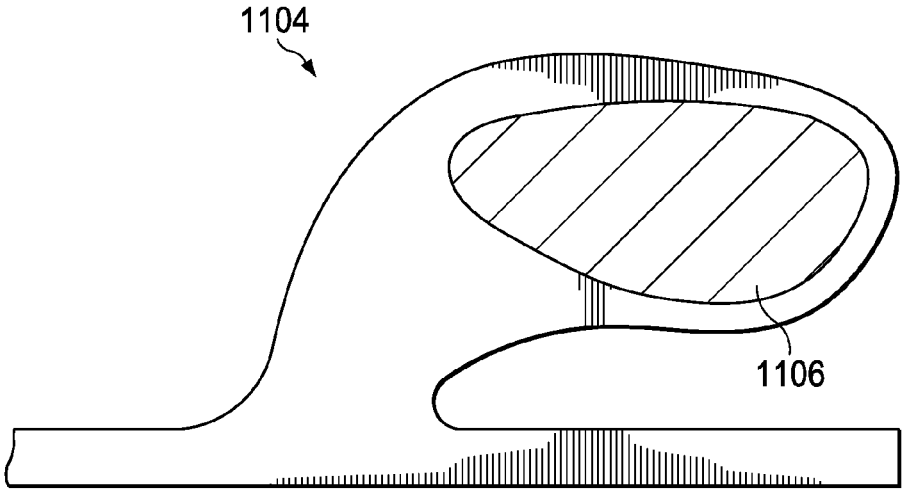
FIG. 11 shows a schematic view of an alternative RF cavity including a single RF chamber suitable for use with a stacked cyclotron in accordance with various embodiments.

FIG. 11 shows an alternative RF cavity 1104 including a single RF chamber 1106 suitable for use with the accelerator stack 130 in accordance with various embodiments. While having only a single RF chamber 1106, the RF cavity 1104 is substantially similar to the RF cavity 904 described above in other respects. Embodiments of the accelerator stack 130 may include one or more of the RF cavity 304, 904, and/or 1104 in any combination.

Figure 12:
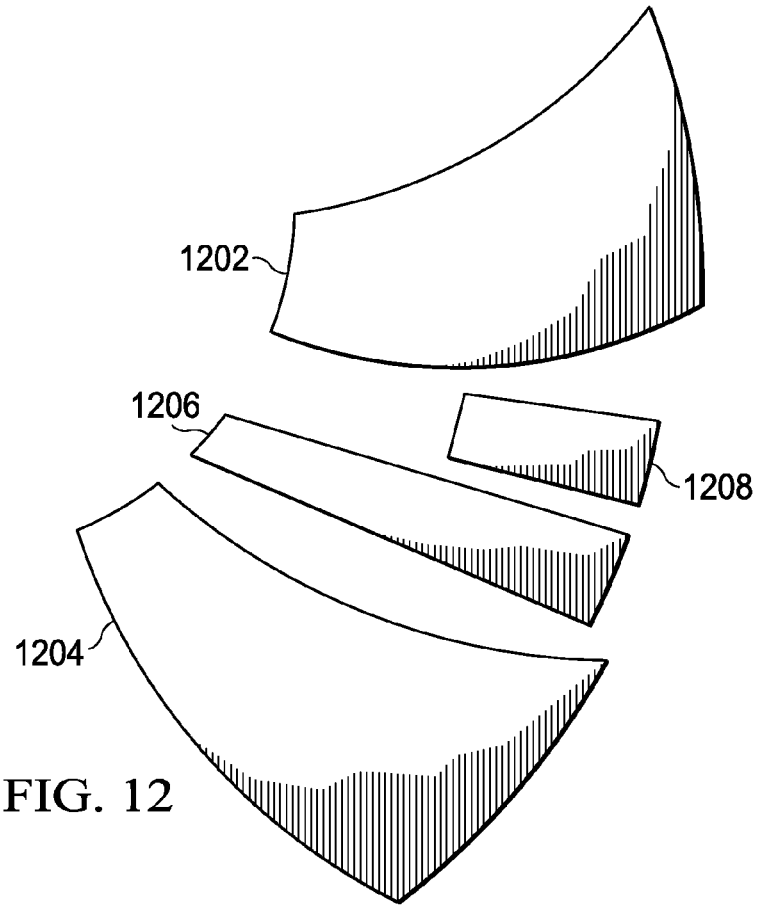
FIG. 12 shows a schematic view of two RF cavities disposed between adjacent sector magnets in accordance with various embodiments.

Some embodiments of the stacked cyclotron 130 may include multiple RF cavities arranged in series between the sector magnets 302. FIG. 12 shows a pair of sector magnets 1202, 1204 and a pair of RF cavities 1206, 1208 disposed between the sector magnets 1202, 1204. The sector magnets 1202 are equivalent to the sector magnet 302 and the RF cavities 1206, 1208 may be any of RF cavities 304, 808, and/or 1104. Outer RF cavity 1208 may be in the outer region where the gap between sector magnets 1202 and 1204 may be greater as they extend radically out from a center of a stacked cyclotron 130. Outer RF cavity 1208 may provide additional energy gain per turn. The additional energy gain per turn may provide additional spacing between successive orbits, facilitating low-loss extraction of the beam at its maximum energy.

Figure 13:
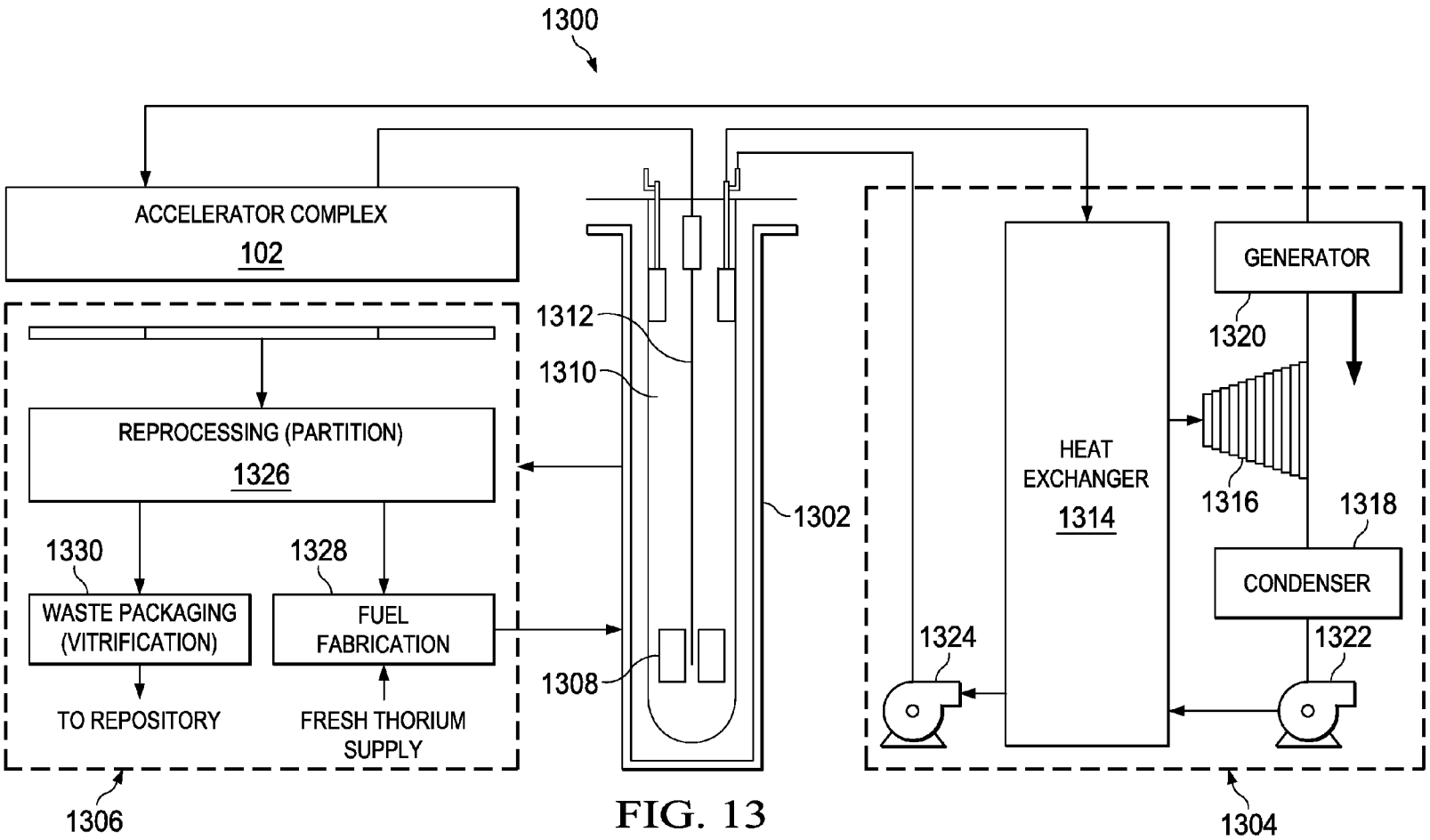
FIG. 13 shows a schematic diagram of a fuel pin based sub-critical core nuclear power generation system in accordance with various embodiments.

FIG. 13 shows a fuel pin based sub-critical core nuclear power generation system 1300 in accordance with various embodiments. The fuel pin based sub-critical core nuclear power generation system 1300 includes the accelerator complex 102 described above, a fuel pin based sub-critical core 1302, power generation 1304, and fuel processing complex 1306. The core 1302 includes fuel pins 1308 that may include thorium. Like the molten salt eutectic system 100 described above, the system 1300 can generate power using thorium-cycle fission. In thorium-cycle fission, thorium ($^{232}$Th) is transmuted to $^{233}$U for fission. The thorium nucleus is not subject to fission, but it will readily capture a fast neutron, becoming the radioactive isotope $^{233}$Th. The $^{233}$Th nucleus decays twice to form the fissionable isotope $^{233}$U. In some embodiments, the same process of transmutation that creates the $^{233}$U may also transmute fission products generated in the core 1302, limiting the accumulation of long-lived waste isotopes in the core 1302.

Transmutation of $^{232}$Th and stimulation of $^{233}$U uses fast neutronics. To achieve fast neutronics, the core 1302 uses a large-atomic-weight material (e.g., molten lead, metal, salt, etc.) as moderator. The heavy moderator, like the heavy carrier salt of the salt 204 described above, allows an energetic (fast) neutron to lose only a small fraction of its energy with each collision or scatter with a moderator nucleus. Thus, the energy of the neutron decreases slowly as it diffuses and scatters within the core 1302. Each neutron thereby retains sufficient energy to have maximum probability to capture on and transmute a $^{232}$Th nucleus, or alternatively to stimulate fission of a $^{233}$U nucleus previously produced through transmutation.

The accelerator complex 102 generates and injects multiple (e.g., 3 or more) beams of energetic protons into the core 1302 that, via spallation, provide some of the neutrons needed to sustain fission. When a proton scatters on a nucleus in the moderator (e.g., a lead nucleus), multiple energetic neutrons are released. The cumulative energy of the multiple proton beams provides neutrons sufficient for fuel transmutation, and sustaining fission in the sub-critical core 1302. Furthermore, because a large-atomic-weight material (e.g., lead) is used as the moderator, the moderator has a relatively large heat capacity and may prevent the core 1302 from heating to a dangerous temperature if the heat transfer systems fail when the core 1302 is shut down.

Heat from the fission may be transferred via convection through the molten column 1310 (e.g., molten lead) of the core 1302 to heat exchanger 1314 located above core 1302. Heat exchanger 1314 transfers the heat from the molten lead to steam which is used to drive steam powered turbine 1316 which, along with generator 1320, generates electricity. As the temperature is increased the thermal efficiency for driving turbine 1316 may improve.

Pumps 1322, 1324 may facilitate movement of the water and molten lead. In particular, pump 1324 may pump the cooled molten lead back to the bottom of core 1302 to close the heat transfer cycle. Condenser 1318 may take the steam that drives turbine 1316 and condense it back into a liquid. Pump 1322 may pump the liquid from condenser 1318 back to heat exchanger 1314 to be converted back into steam.

FIG. 14 illustrates a block diagram of an overhead view of a proton beam distribution pattern in the core 1302 in accordance with various embodiments. The thorium fuel of core 1302 is contained in fuel pins 1308 that are assembled into bundles 1450. The space between the fuel pins is filled with a molten material, such as lead. An additional layer 1460 of molten metal along the outermost radius of core 1302 serves as a neutron reflector. In the depicted embodiment, core 1302 is driven by seven proton beams 1420 distributed equidistant from one another. The distribution of proton beams 1420 may help to maintain the generation of spallation neutrons with a flux that may be approximately homogeneous throughout the region of core 1302 containing thorium fuel. In some embodiments, beams 1420 may, cumulatively, provide approximately 15 MW of continuous beam power of protons (e.g., corresponding to approximately 12 mA of current at 800 MeV of kinetic energy).

Each proton beam 1420 is directed from a cyclotron of the cyclotron stack 130 to a different one of spallation zones 1440 within core 1302 through respective evacuated tubes, proton beam injection channels 1430. Each proton beam injection channel 1430 may be arranged parallel to the vertical axis of core 1302 (e.g., perpendicular to the top surface of core 1302) and may stop at core 1302 or extend, either fully or partially, through the core 1302. Proton beam injection channels 1430 may be disposed in a symmetric pattern within core 1302. This arrangement may have the effect of approximating a volumetric feed of neutrons throughout the core 1302. This may be done with a pattern of 3 beams for an approximately 0.5 giga-watt (GW) core, a pattern of 7 beams (6-on-1) for an approximately 1.2 GW core, or a larger multiplicity of beams for a yet higher power core. In addition, the use of multiple beams 1420 may reduce the attenuation of neutrons in the outer regions of core 1302, allowing the power density of core 1302 to remain relatively flat through a prolonged period of operation. In some embodiments, the fuel pin bundles 1450 may be used continuously (e.g., without being reshuffled) during the prolonged period of operation.

Proton beams 1420, injected into each proton beam injection channel 1430, may be scanned by one or more steering elements so that the protons within proton beams 1420 strike the side walls of proton beam injection channels 1430 with an approximately tangential orientation. In some embodiments, mercury vapor based high-power targeting may be used. A mercury vapor target may give optimum targeting for high-power proton or ion beams, yet the target would be a Hg vapor column that is continuously being condensed and re-circulated so that there is nothing that can be destroyed or radiation-damaged. For example, a liquid mercury target may be produced as the beam enters a 'fountain' flow of liquid mercury. The liquid column may be disrupted by the liquid flow, but recovers shortly thereafter so that a subsequent bunch can be targeted. Particular embodiments may comprise a high-density column of mercury vapor. The metal mercury has the unique property that it is liquid at room temperature and also has large vapor pressure at moderate temperature.

When a proton strikes the tube wall it passes into the spallation zone 1440 and produces a sequence of nuclear scatterings that yield a longitudinally distributed flux of spallation neutrons around each proton beam 1420. A proton having approximately 800 MeV of kinetic energy may produce approximately twenty fast neutrons through spallation. The spallation neutrons gradually lose energy by elastic collisions with lead nuclei. As the spallation neutrons pass through fuel pins bundles 1450 they can be captured by $^{232}$Th nuclei to transform them into the heavier isotope $^{233}$Th.

Spallation zone 1440 may comprise a molten metal, such as lead. In certain embodiments, core 1302 may be immersed in a bath of molten metal (e.g., lead). The molten metal may fill spallation zones 1440 and serve as a spallation target, a fast neutron moderator, and a medium for convective heat transfer. In some embodiments, a molten salt slurry may be used instead of molten lead or molten metal.

Evenly distributing the proton beams may increase the efficiency with which the fuel rods 1308 in the core 1302 are consumed. In particular, because fission products have a relatively high probability of capturing fast neutrons, fission products tend to accumulate near the region where a proton beam 1420 is injected thereby reducing the neutron flux that can reach further from the point of injection. This effectively turns-off the core 1302 in regions distant from the point of injection. The symmetric pattern of injection employed in system 1300 may provide a volumetric feed of spallation neutrons which is not significantly modified by shadowing. Thus allowing for power distribution to remain nearly uniform throughout core 1302 and the overall power generation to be maintained at a nearly constant level over a multi-year period of operation. In some embodiments, core 1302 may be operated for up to ten years without accessing core 1302 or shuffling the fuel rods 1308 within core 1302.

At high temperatures molten lead may be chemically active. For example, it may migrate along grain boundaries in steel and other metals. This may lead to corroding of the weak-link attachment between grains so that the metal becomes brittle and subject to fatigue, swelling, and stress cracking. Some embodiments of the fuel rods 1308, or other components of the core 1302, may include a cladding material such as a metal-matrix composite (MMC), in which filaments of ceramic are embedded within a high-strength matrix metal. Certain embodiments may include forming the MMC by coating the ceramic fibers with a nanolayer of titanium. Titanium readily bonds to most ceramics at high temperature, diffusing the titanium into the surface layer of ceramic. This may grade the composition and with it the temperature coefficient (tempco) of expansion (tempco mismatch, a major problem for metal-ceramic bonds). The titanium surfaced fiber may be coated with a nanolayer of the desired matrix metal. The two coatings and the diffusion may be applied under high vacuum, without breaking to air between coatings. The titanium may serve as adhesion layer and also to grade tempco.

The core 1302 may be designed so that it remains safe to restart after an extended down-time. During operation of core 1302 there may be an inventory of the intermediary isotope $^{233}$Pa. $^{233}$Pa may be formed after neutron capture on $^{232}$Th and subsequent rapid beta decay. $^{233}$Pa has a one-month half-life for its beta decay into the $^{233}$U that is the fissile fuel. Thus, if the proton beams fail or are shut-off (and with them the fission reaction), the inventory of $^{233}$Pa continues to beta-decay into $^{233}$U over the following months. When core 1302 is restarted it may have more $^{233}$U than it did when the proton beams were shut-off. This may shift the criticality of the core 1302 by up to 2%. Certain embodiments may be designed with that consideration in mind and may thus limit the choice of criticality in designing the core (e.g., it may be designed so that it is impossible for it to go critical under any circumstance.

As fission proceeds in the core 1302, fuel is consumed. Consequently, the core 1302 may periodically be reloaded with fresh fuel. The fresh fuel may include fresh thorium and actinides which are combined in a fuel fabrication block 1328. The fresh fuel is loaded into core 1302 while the spent fuel is removed. The spent fuel is removed from the core 1302 is sent to a reprocessing block 1326 which removes the fission fragments and sends them to waste packaging 1330 while the actinides are separated and sent to the fuel fabrication 1328 to be combined with the fresh thorium. The waste packaging of the fission fragments is then sent to a repository for storage.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A fission power generator, comprising:

a sub-critical core, and a plurality of proton beam generators, each of the proton beam generators configured to concurrently provide a proton beam into a different area of the sub-critical core;

wherein each proton beam scatters neutrons within the sub-critical core, and the plurality of proton beam generators provide aggregate power to the sub-critical core, via the proton beams, to scatter neutrons sufficient to initiate fission in the sub-critical core;

wherein the proton beam generators are isochronous cyclotrons, each of the cyclotrons comprising folded radio frequency cavities each cavity comprising a horizontal lobe disposed above a proton beam aperture and a horizontal lobe disposed below the proton beam aperture, wherein each lobe extends lengthwise along an orbital plane of the cyclotron.

2. The fission power generator of claim 1, wherein the cyclotrons are configured to share a flux return in a sector magnet flux-coupled stack.

3. The fission power generator of claim 2, wherein a beam aperture of the sector magnet flux-coupled stack comprises pole faces having ridges aligned in curvature of beam travel, the ridges producing at least a quadrupole gradient that focuses a proton beam passing through the aperture.

4. The fission power generator of claim 3, wherein each ridge comprises faces and each face comprises superconducting windings that produce at least a quadrupole gradient that focuses the proton beam passing through the aperture.

5. The fission power generator of claim 2, wherein a beam aperture of the sector magnet flux-coupled stack comprises pole faces having windings that produce at least a quadrupole gradient that focuses a proton beam passing through the aperture.

6. The fission power generator of claim 2, wherein the longitudinal sides of the sector magnet flux coupled stack are flat.

7. The fission power generator of claim 1, wherein the sub-critical core comprises a molten mixture of fuel salt and heavy carrier salt.

8. The fission power generator of claim 7, further comprising:

a core vessel; and a containment vessel;

wherein the core vessel comprises:

an inner vessel that contains the molten mixture;

a lead outer vessel disposed about the inner vessel; and a multi-layer heat shield disposed between the inner vessel and the outer vessel.

9. The fission power generator of claim 8, wherein a space between the inner vessel and the outer vessel comprises helium while configured to conduct heat from the inner vessel to the outer vessel, and comprises vacuum while configured to inhibit heat conduction from the inner vessel to the outer vessel.

10. The fission power generator of claim 8, further comprising a lanthanide distillation system disposed within the containment vessel, wherein, during power generator operation, the lanthanide distillation system extracts lanthanides from the molten mixture, and stores the lanthanides in a lanthanide storage vessel.

11. The fission power generator of claim 8, further comprising heat pipes coupled to the outer vessel, the heat pipes configured to conduct heat away from the outer vessel.

12. The fission power generator of claim 8, further comprising a cryotrap disposed within the containment vessel, wherein the cryotrap configured to extract volatiles the sub-critical core.

13. The fission power generator of claim 1, further comprising a plurality of spallation targets disposed within the sub-critical core, wherein at least one spallation target receives protons from each of the proton beam generators, and ejects neutrons based on the received protons.

14. The fission power generator of claim 1, wherein each proton beam comprises at least 700 megaelectronvolts of energy and the plurality of proton beams comprises at least 10 megawatts of power.

* * * * *